US007965962B2

(12) United States Patent
Mori

(10) Patent No.: US 7,965,962 B2
(45) Date of Patent: Jun. 21, 2011

(54) DEVELOPING DEVICE HAVING GEARS WITH MOVEABLE POSITIONS

(75) Inventor: Hiroki Mori, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 198 days.

(21) Appl. No.: 12/145,178

(22) Filed: Jun. 24, 2008

(65) Prior Publication Data

US 2008/0317509 A1 Dec. 25, 2008

(30) Foreign Application Priority Data

Jun. 25, 2007 (JP) ..... 2007-166673

(51) Int. Cl.
*G03G 15/08* (2006.01)

(52) U.S. Cl. ..... 399/254; 399/119; 399/258; 399/222; 399/261

(58) Field of Classification Search ..... 399/119, 399/254, 258, 222, 262
See application file for complete search history.

(56) References Cited

U.S. PATENT DOCUMENTS

| | | | | |
|---|---|---|---|---|
| 5,913,097 | A | 6/1999 | Nakano et al. | |
| 2006/0088340 | A1 | 4/2006 | Kimijima et al. | |
| 2006/0104670 | A1* | 5/2006 | Nishitani et al. | 399/258 |
| 2006/0171739 | A1* | 8/2006 | Nakaya | 399/119 |

FOREIGN PATENT DOCUMENTS

| | | |
|---|---|---|
| EP | 0 650 105 | 4/1995 |
| EP | 1 657 600 | 5/2006 |
| JP | 09-222785 | 8/1997 |
| JP | 10-240008 | 9/1998 |
| JP | 2006-208532 | 8/2006 |

OTHER PUBLICATIONS

Search Report received for corresponding European Application 08 01 0628, mailed Feb. 18, 2011.

* cited by examiner

*Primary Examiner* — David M Gray
*Assistant Examiner* — G. M. Hyder
(74) *Attorney, Agent, or Firm* — Banner & Witcoff, Ltd.

(57) ABSTRACT

A developing device includes a developing housing that supports a developer carrier, and a developer cartridge. The developer cartridge includes a cartridge housing that is configured to accommodate developer, an agitator that is provided in the cartridge housing and is configured to agitate the developer by a driving force, and a transmission gear that is configured to transmit the driving force to the agitator. The developing housing comprises a moving gear that is movable between a meshing position in which the moving gear meshes with the transmission gear and a spaced-apart position in which the moving gear is spaced apart from the meshing position. The moving gear is configured to transmit the driving force from the transmission gear to the agitator.

12 Claims, 10 Drawing Sheets

UPPER SIDE
FRONT SIDE
LEFT SIDE
LOWER SIDE
RIGHT SIDE
BACK SIDE

DEVELOPING DEVICE HAVING GEARS WITH MOVEABLE POSITIONS

CROSS-REFERENCE TO RELATED APPLICATIONS

This application claims priority from Japanese Patent Application No. 2007-166673 filed on Jun. 25, 2007, the entire subject matter of which is incorporated herein by reference.

TECHNICAL FIELD

The present invention relates to a developing device which is attachable to an image forming apparatus.

BACKGROUND

As a related art developing device, for example, JP-A-10-240008 describes a process cartridge, in which a development roller and a developer cartridge are housed in a casing, and the developer cartridge is detachable with respect to the casing.

The casing includes a drive shaft member for receiving a driving force from a motor or the like. An agitation part for agitating developer in the interior of the developer cartridge is accommodated in the developer cartridge, and an engaging recess is provided in an end portion of a rotating shaft of the agitation part. When the developer cartridge is attached to the casing, the drive shaft member is fitted in and coupled with the engaging recess, and the driving force is transmitted from the drive shaft member to the agitation part.

The above described related art developer cartridge has some disadvantages. For example, if gear teeth are formed on each of the drive shaft member and the engaging recess, and as their gear teeth mesh, the drive shaft member is coupled with the engaging recess.

In that case, when the developer cartridge is installed to the casing, there is a possibility that tips of the gear teeth of the drive shaft member and tips of the gear teeth of the engaging recess collide against each other in the course of the installation. In that case, since the gear teeth of the drive shaft member and the gear teeth of the engaging recess become unable to mesh, it becomes difficult to smoothly install the developer cartridge to the casing. Thus, the tips of the respective gear teeth of the drive shaft member and the engaging recess can be damaged.

SUMMARY

Aspects of the invention provide a developing device in which a developer cartridge can be smoothly installed to the developing housing by allowing the gear provided in the developer cartridge and the gear provided in the developing housing to be smoothly meshed.

According to an aspect of the invention, there is provided a developing device comprising: a developing housing that supports a developer carrier; and a developer cartridge comprising: a cartridge housing that is configured to accommodate developer; an agitator that is provided in the cartridge housing and is configured to agitate the developer by a driving force; and a transmission gear that is configured to transmit the driving force to the agitator, wherein the developing housing comprises a moving gear that is movable between a meshing position in which the moving gear meshes with the transmission gear and a spaced-apart position in which the moving gear is spaced apart from the meshing position, and wherein the moving gear is configured to transmit the driving force from the transmission gear to the agitator.

Alternatively, the developing device may be configured such that the transmission gear comprises gear teeth on an end face thereof in a perpendicular direction to a longitudinal direction of the developer carrier, the developer cartridge is attachable to and detachable from the developing housing along the perpendicular direction, and the moving gear comprises gear teeth formed on an end face thereof in the perpendicular direction.

According to the aspect of the invention, when the developer cartridge is installed in the developing housing, and the moving gear of the developing housing and the transmission gear of the developer cartridge are meshed with each other, the driving force is transmitted from the moving gear to the agitator through the transmission gear. Hence, it is possible to rotate the agitator to agitate the developer.

Here, the developer cartridge is installed to or removed from the developing housing along a perpendicular direction which is perpendicular to the longitudinal direction of the developer carrier. In the transmission gear, gear teeth are formed on its end face in the perpendicular direction, and in the moving gear as well, gear teeth are formed on its end face in the perpendicular direction. In this case, at the time of installing the developer cartridge to the developing housing, there is a possibility that tooth tips of the transmission gear and tooth tips of the moving gear collide against each other.

However, the moving gear is movable between the meshing position for meshing with the transmission gear and the spaced-apart position spaced apart from the meshing position. For this reason, if the moving gear is kept disposed at the spaced-apart position, a collision between tooth tips of the transmission gear and tooth tips of the moving gear can be prevented when the developer cartridge is installed to the developing housing. In addition, even if the moving gear is not disposed at the spaced-apart position, in the case where the tooth tips of the transmission gear and the tooth tips of the moving gear have collided, the moving gear is able to retreat to the spaced-apart position side, so that it is possible to alleviate the shock at the time of the collision. Then, as the moving gear is moved to the meshing position upon completion of the installation of the developer cartridge to the developing housing, the moving gear and the transmission gear can be reliably meshed with each other.

Consequently, the transmission gear of the developer cartridge and the moving gear of the developing housing can be smoothly meshed without being damaged, so that the developer cartridge can be smoothly installed to the developing housing.

BRIEF DESCRIPTION OF THE DRAWINGS

FIGS. 7A to 7D are enlarged left side views of the process cartridge of FIG. 2, in a state in which the developer cartridge is attached to the process frame, in which FIG. 7A shows a state in which the developer cartridge is detached from the process frame; FIG. 7B shows a state in which the developer cartridge is attached to the process frame and both the transmission gear and the drive gear are at spaced apart positions in FIG. 7A; FIG. 7C shows a state in which the transmission gear is at the meshing position and the drive gear is at the spaced-apart position in FIG. 7B; and FIG. 7D shows a state in which the drive gear is at the meshing position in FIG. 7C.

DETAILED DESCRIPTION

Exemplary embodiments of the invention will be described now with reference to the drawings.

(Image Forming Apparatus)

Figure 1:
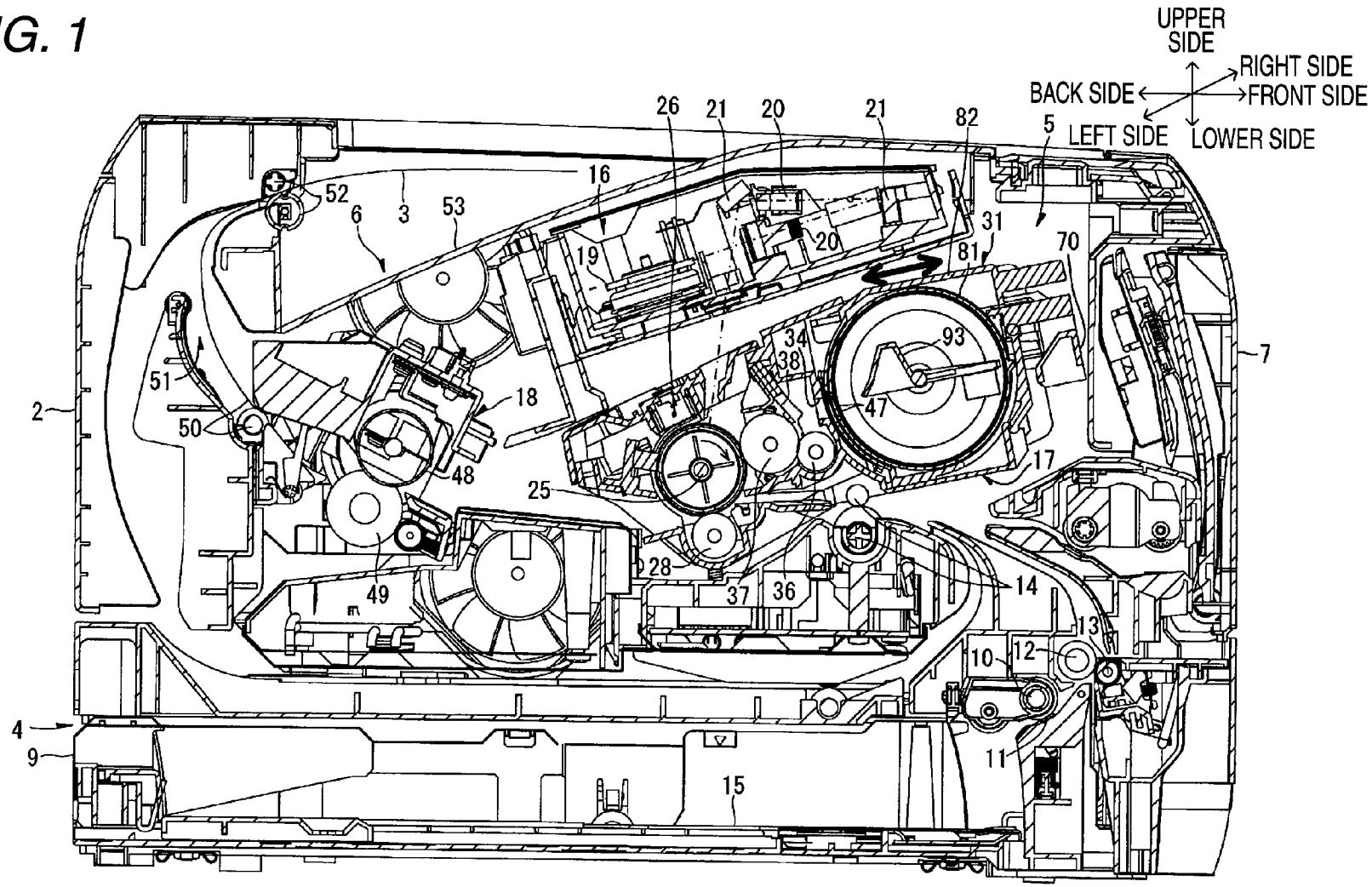
FIG. 1 is an exemplary side sectional view of an image forming apparatus according to an exemplary embodiment of the present invention.

As shown in FIG. 1, an image forming apparatus 1 according to an exemplary embodiment of the present invention includes a feeder unit 4 for feeding sheets 3 to an interior of a body casing 2, an image forming unit 5 for forming an image on the fed sheet 3, and a sheet discharge part 6 for discharging the sheet 3 with the image formed thereon.

(1) Body Casing

The body casing 2 is formed in a box shape, an open port is formed in one side wall of the body casing 2, and a front cover 7 for opening and closing the open port is provided. By opening the front cover 7, a process cartridge 17 (which will be described later) as an example of a developing device can be attached to or detached from the body casing 2 along the directions of thick-line arrows in the drawing.

The body casing 2 is provided with a developer sensor (not shown) for detecting the amount of developer accommodated in the developer cartridge 31. The developer sensor (not shown) includes a light emitting portion (not shown) for emitting detection light and a light receiving portion (not shown) for receiving this detection light. The light emitting portion (not shown) and the light receiving portion (not shown) are disposed in such a manner as to sandwich the process cartridge 17 and the developer cartridge 31 in the widthwise direction. For example, the light emitting portion (not shown) may be disposed on the left side of the process cartridge 17, while the light receiving portion (not shown) may be disposed on the right side of the process cartridge 17. In this case, the detection light transmits from the left side to the right side. Alternatively, the light emitting portion and the light receiving portion may be positioned on opposite sides of the process cartridge 17, respectively.

(2) Feeder Unit

The feeder unit 4 includes a sheet feed tray 9, a feed roller 10, a feed pad 11, paper dust removing rollers 12 and 13, a register roller 14, and a sheet pressing plate 15. Uppermost ones of the sheets 3 on the sheet pressing plate 15 are fed one by one by the feed roller 10 and the feed pad 11, and the fed sheet 3, after passing through the various rollers 12 to 14, is transported to a transfer position (which will be described later) of the image forming unit 5.

(3) Image Forming Unit

The image forming unit 5 includes a scanner unit 16, the process cartridge 17, and a fixing part 18.

(3-1) Scanner Unit

The scanner unit 16 is provided at an upper portion inside the body casing 2, and includes a laser light emitting part (not shown), a polygon mirror 19 which is rotatively driven, a plurality of lenses 20, and a plurality of reflecting mirrors 21. A laser beam emitted from the laser light emitting part on the basis of image data is reflected by the polygon mirror 19, is transmitted through or reflected by the plurality of lenses 20 and the plurality of reflecting mirrors 21, and is made to scan the surface of a photoconductive drum 25 (which will be described later) of the process cartridge 17.

(3-2) Process Cartridge

The process cartridge 17 is disposed below the scanner unit 16 inside the body casing 2, and is installed detachably with respect to the body casing 2.

Figure 2:
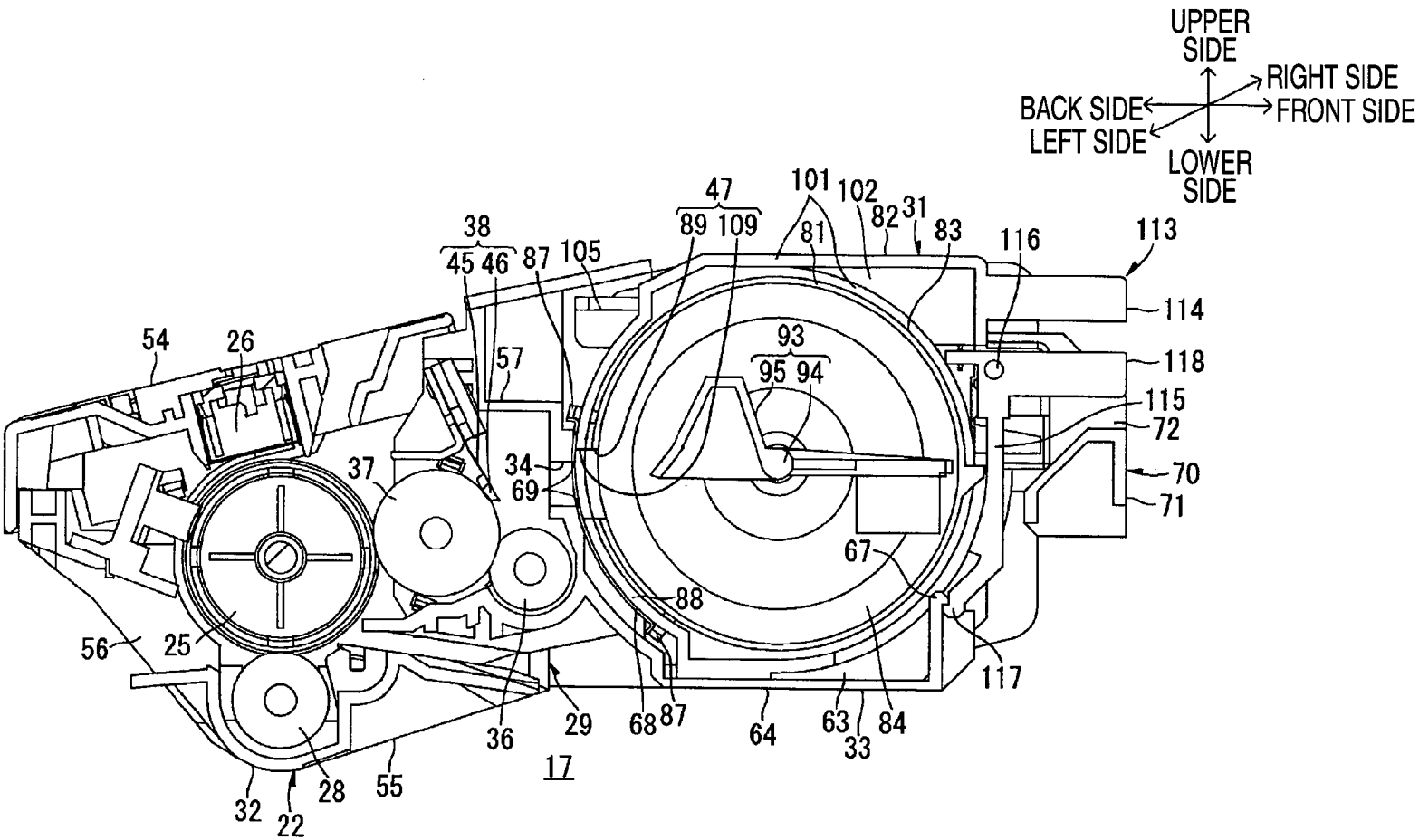
FIG. 2 is a side sectional view of a process cartridge, according to an exemplary embodiment of the present invention, of the image forming apparatus shown in FIG. 1, wherein the process cartridge is in a state in which a developer cartridge is attached to a process frame and a swing arm is at a pressing position.

As shown in FIG. 2, the process cartridge 17 includes a process frame 22 as an example of a developing housing having a transfer path 29 formed in the developing housing to allow the passage of the sheet 3, as well as the developer cartridge 31 which is detachably installed in a cartridge housing part 33 (which will be described later) of the process frame 22.

A vertically extending partition wall 57 is provided in the process frame 22 at a substantially central position of a front-back direction of the process frame 22. In the process frame 22, a rear side portion of the partition wall 57 is formed as a developing part 32, while a front side portion of the partition wall 57 is formed as the aforementioned cartridge housing part 33. The frame-side passage port 34 is formed in the partition wall 57.

The following are provided in the developing part 32: the photoconductive drum 25; a scorotron-type charger 26; a transfer roller 28; a supply roller 36; a development roller 37 as an example of a developer carrier, and a layer thickness restricting blade 38.

The photoconductive drum 25 is elongated in the widthwise direction and is rotatably supported by the process frame 22. The scorotron-type charger 26 is supported by the process frame 22 above the photoconductive drum 25 at an interval with the photoconductive drum 25. The transfer roller 28 is elongated in the widthwise direction, is disposed on and is opposed to a lower side of the photoconductive drum 25, and is rotatably supported by the process frame 22. The development roller 37 is elongated in the widthwise direction, is disposed on and is opposed to a lower side of the photoconductive drum 25, and is rotatably supported by the process frame 22. The development roller 37 is elongated in the widthwise direction and is disposed on and is opposed to a front side of the photoconductive drum 25. The supply roller 36 is elongated in the widthwise direction and is disposed on and is opposed to a front side of the development roller 37. The development roller 37 and the supply roller 36 are rotatably supported by the process frame 22. The layer thickness restricting blade 38 has a leaf spring member 45 formed in a thin plate shape and pressure contact rubber 46 provided on a lower end portion of the leaf spring member 45. An upper end portion of the leaf spring member 45 is fixed to the process frame 22, and the pressure contact rubber 46 presses the surface of the development roller 37 by the resiliency of the leaf spring member 45.

The developer cartridge 31 is mounted in the cartridge housing part 33 detachably with respect to the process frame 22. The developer cartridge 31 has a substantially hollow cylindrical shape. The cartridge-side passage port 47 for allowing the inner side and the outer side to communicate with each other is formed in the developer cartridge 31.

An agitator 93 as an example of an agitating member is rotatably provided in the developer cartridge 31. In addition, positively charged, non-magnetic one component developer is accommodated in the developer cartridge 31 as an example of developer.

The developer in the developer cartridge 31 is agitated by the rotation of the agitator 93, is received into the frame-side passage port 34 from the cartridge-side passage port 47, and is released into the developing part 32. The released developer is supplied onto the supply roller 36.

The developer supplied onto the supply roller 36 is supplied onto the development roller 37 as the supply roller 36 is rotated. The developer is frictionally charged to a positive polarity between the supply roller 36 and the development roller 37. Subsequently, in conjunction with the rotation of the development roller 37, the developer supplied onto the development roller 37 enters a nip between the pressure contact rubber 46 and the development roller 37, and while the layer thickness is being restricted therebetween, the developer is carried on the surface of the development roller 37 as a thin layer.

Then, in conjunction with the rotation of the photoconductive drum 25, the surface of the photoconductive drum 25 is first positively charged uniformly by the scorotron-type charger 26, and is subsequently exposed by a laser beam from the scanner unit 16, thereby forming an electrostatic latent image based on image data. As the development roller 37 is rotated, the developer being carried on the development roller 37 is supplied onto the electrostatic latent image formed on the surface of the photoconductive drum 25 when the developer is opposed to and is brought into contact with the photoconductive drum 25. The electrostatic latent image is thereby developed (formed into a visible image), and a developer image is carried on the surface of the photoconductive drum 25. This developer image is transferred onto the sheet 3 transported between the photoconductive drum 25 and the transfer roller 28 (to the transfer position) in the transfer path 29.

(3-3) Fixing Part

As shown in FIG. 1, the fixing part 18 is provided on the rear side of the process cartridge 17. The fixing part 18 includes a heating roller 48, a pressure roller 49 which is brought into pressure contact with the heating roller 48 from the lower side, and a pair of transport rollers 50 disposed on the rear side of these rollers.

In the fixing part 18, the developer transferred onto the sheet 3 at the transfer position is thermally fixed while the sheet 3 passes between the heating roller 48 and the pressure roller 49. Subsequently, the sheet 3 is transported to the sheet discharge part 6 by the pair of transport rollers 50.

(4) Sheet Discharge Part

The sheet discharge part 6 includes a sheet discharge path 51, a sheet discharge roller 52, and a sheet discharge tray 53. The sheet 3 transported from the fixing part 18 to the sheet discharge path 51 is transported from the sheet discharge path 51 to the sheet discharge roller 52 and is discharged onto the sheet discharge tray 53 by the sheet discharge roller 52.

(Process Cartridge)

Referring to FIGS. 3 to 7C, a process cartridge according to an exemplary embodiment of the present invention will be described. The process cartridge will now be described with reference to FIGS. 3 to 7C.

(1) Process Frame

Figure 3:
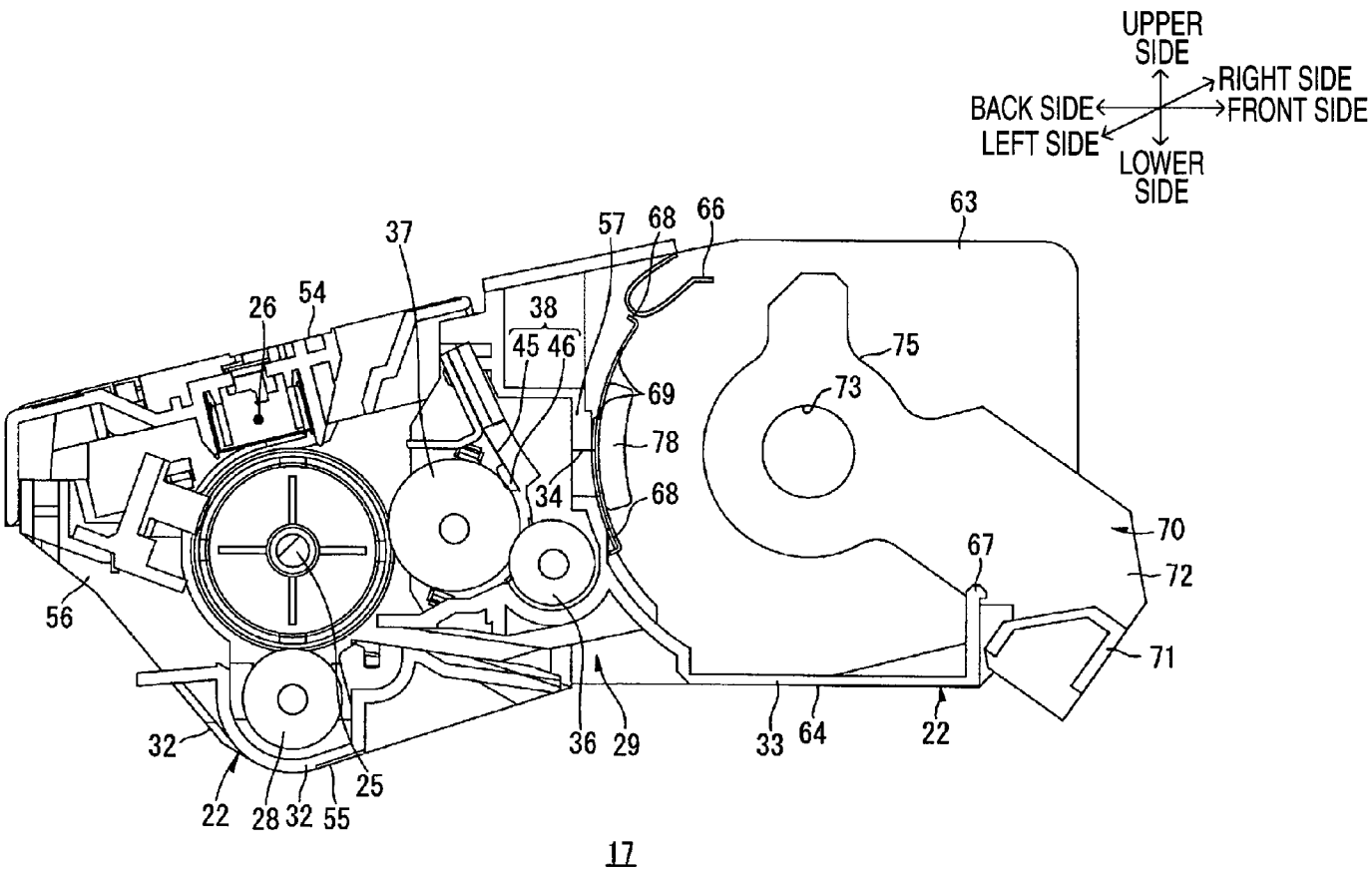
FIG. 3 is a side sectional view of the process cartridge of FIG. 2, wherein the process cartridge is in a state in which the developer cartridge is detached from the process frame and the swing arm is at a pressing releasing position.

As shown in FIG. 3, the process frame 22 integrally has the developing part 32 and the cartridge housing part 33 described above.

(1-1) Developing Part

Figure 4:
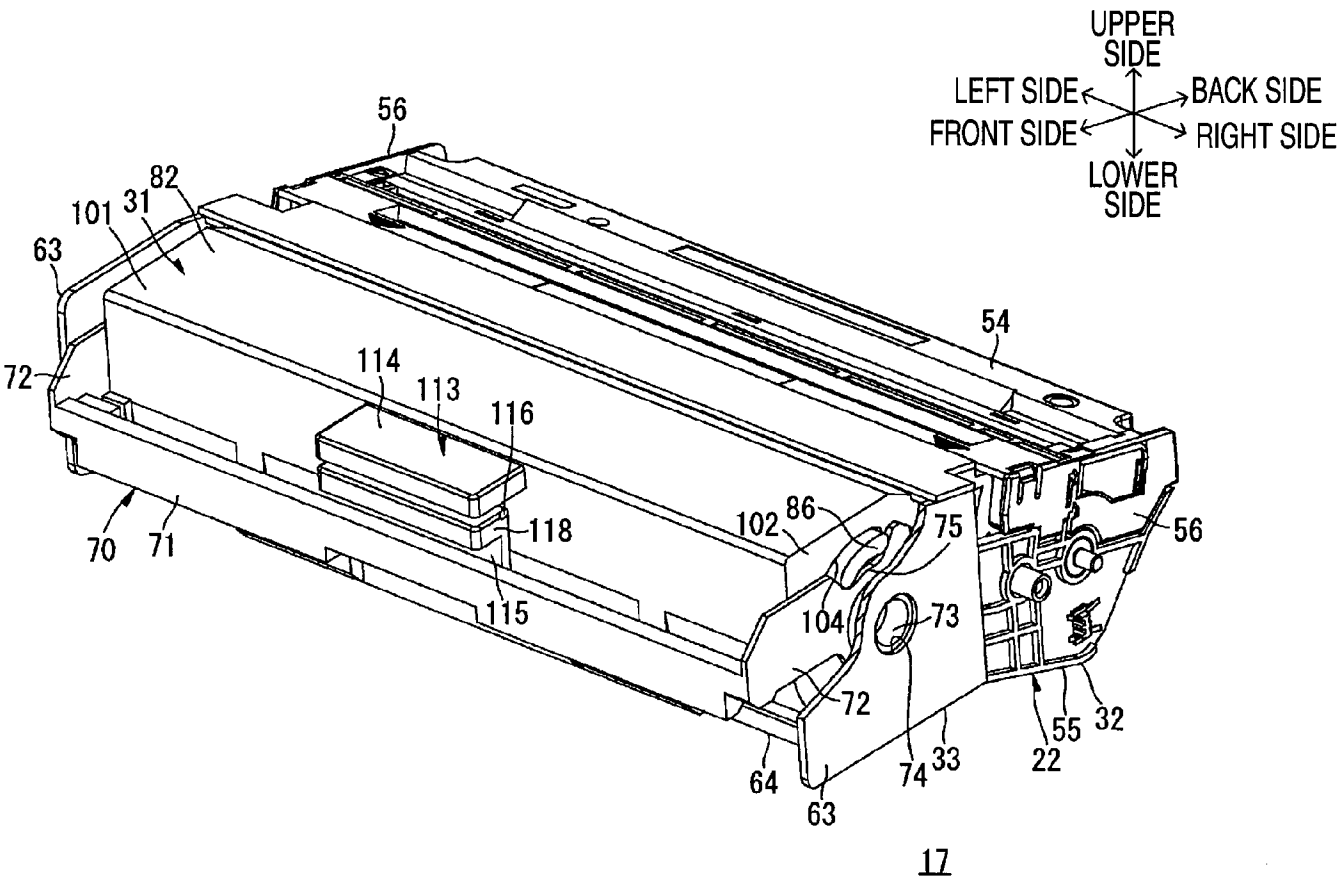
FIG. 4 is a schematic perspective view, as viewed from a front right side, of the process cartridge of FIG. 2.

As shown in FIGS. 3 and 4, the developing part 32 integrally has an upper wall 54, a bottom wall 55, two side walls 56, and the aforementioned partition wall 57. The two side walls 56 are opposed to each other at an interval therebetween in the widthwise direction. The respective side walls 56 are arranged along the front-back direction.

Figure 6:
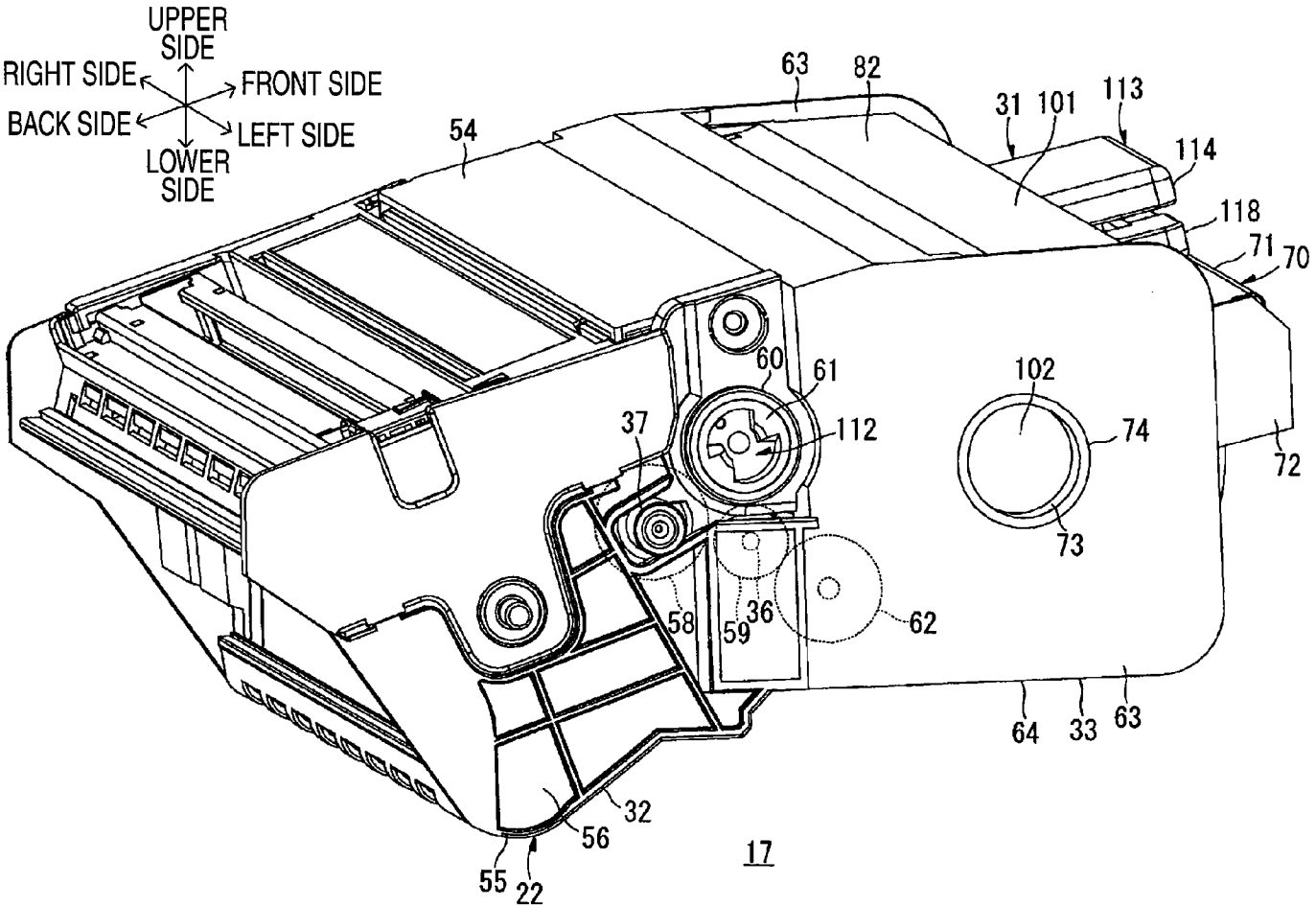
FIG. 6 is a perspective view of the process cartridge of FIG. 2 as viewed from a back left side, in a state in which the developer cartridge is attached to the process frame.

The development roller 37 is supported by the process frame 22 by being rotatively supported by front side portions of the both side walls 56 (see FIG. 3). As shown in FIG. 6, a development gear 58 is mounted on a left end portion of the development roller 37 relatively unrotatably with respect to the development roller 37. Specifically, the development gear 58 is disposed on the right side (i.e., that inner side in the widthwise direction) of the left side wall 56. The development gear 58 is a gear whose circle center is a rotating shaft (i.e., a shaft extending in the widthwise direction) of the development roller 37, and the gear teeth of the development gear 58 are formed on an outer peripheral surface of the development gear 58 (i.e., an end face in a direction perpendicular to the widthwise direction).

The supply roller 36 is supported by the process frame 22 on the front side of the development roller 37 by being rotatably supported by front portions of the both side walls 56 (see FIG. 3). A supply gear 59 as an example of a pressing gear is mounted on a left end portion of the supply roller 36 relatively unrotatably with respect to the supply roller 36. Specifically, the supply gear 59 is disposed on the right side (i.e., an inner side in the widthwise direction) of the left side wall 56. The supply gear 59 is a gear whose circle center is a rotating shaft (i.e., a shaft extending in the widthwise direction) of the supply roller 36, and the gear teeth of the supply gear 59 are formed on an outer peripheral surface of the supply gear 59 (i.e., an end face in the direction perpendicular to the widthwise direction).

A drive gear 62 as an example of a moving gear is provided on the front side of the supply gear 59. The drive gear 62 is a gear whose circle center is a rotating shaft extending in the widthwise direction, and its gear teeth are formed on its outer peripheral surface (an end face in a perpendicular direction which is perpendicular to the widthwise direction). The drive gear 62 meshes with the supply gear 59 from the front side. The drive gear 62 is rotatably supported about the circle center by the left side wall 56 (including a portion of a left side plate 63 which will be described later) in a state in which front-side gear teeth are exposed in the cartridge housing part 33. Specifically, as shown in FIGS. 7A to 7D, an elongated hole (referred to as a guide hole 40) extending in a substantially vertical direction (specifically, a direction connecting a diagonally forward upper side and a diagonally backward lower side) is formed in the left side wall 56. The rotating shaft of the drive gear 62 is loosely fitted in the guide hole 40. As a result, in the state in which the drive gear 62 is meshed with the supply gear 59, the drive gear 62 is movable between the spaced-apart position (see FIGS. 7A, 7B, and 7C) and the meshing position (see FIG. 7D) as the drive gear 62 is guided by the guide hole 40. The guide hole 40 functions as an example of a guide portion.

When the drive gear 62 is at the spaced-apart position, the rotating shaft of the drive gear 62 is located at a lower end of the guide hole 40, and when the drive gear 62 is at the meshing position, the rotating shaft of the drive gear 62 is located at an upper end of the guide hole 40. In other words, the spaced-apart position is a position spaced apart downward from the meshing position, and the guide hole 40 is provided continuously in such a manner as to span the meshing position and the spaced-apart position so as to support the drive gear 62. It should be noted that the guide hole 40 may not be a hole and may be a groove which is recessed in the left side wall 56.

In addition, one end of an elastic body 41 such as a spring is engaged with the rotating shaft of the drive gear 62. The elastic body 41 functions as an example of an actuating member. The other end of the elastic body 41 is engaged with the process frame 22 below the drive gear 62, and the drive gear 62 is constantly pressed downward, i.e., toward the spaced-apart position, by the resiliency of the elastic body 41.

As shown in FIG. 6, a supporting hole 60 extending through the left side wall 56 is formed in the left side wall 56 at a position located on the front side of the development gear 58 and on the upper side of the supply gear 59. The supporting hole 60 has a circular shape in a side view. A coupling gear 61 is fitted in the supporting hole 60.

The coupling gear 61 is a gear whose circle center is a rotating shaft extending along the widthwise direction, and is rotatably supported about the circle center by the left side wall 56. Gear teeth, which respectively mesh with the development gear 58 and the supply gear 59, are formed on a right end of an outer peripheral surface (i.e., an end face in the direction perpendicular to the widthwise direction) of the coupling gear 61. A recessed portion 112, which is recessed toward the right side and is formed substantially in the shape of a FIG. 8 in a side view, is formed on a left end face of the coupling gear 61. This recessed portion 112 is exposed to the left side through the supporting hole 60.

Figure 7A:
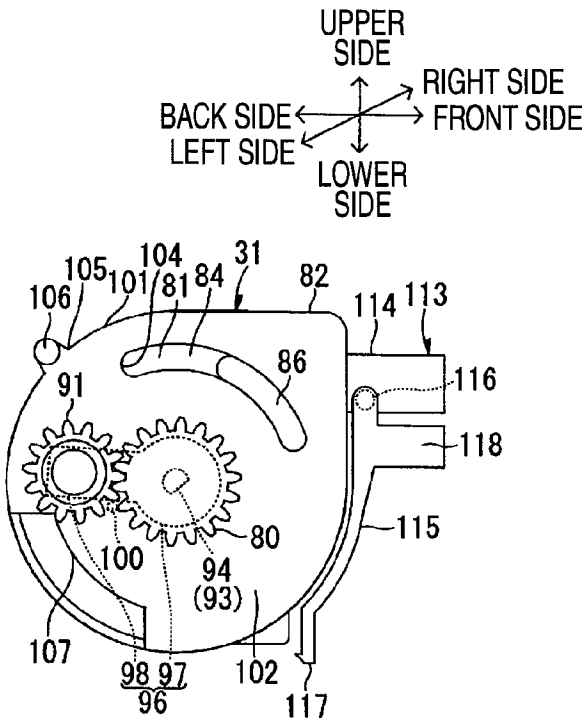
Figure 7A:
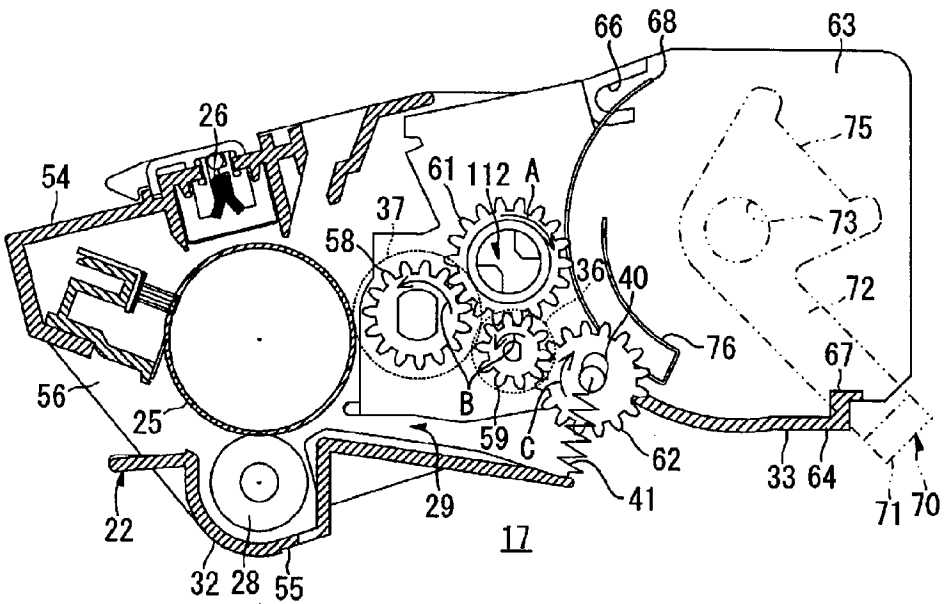

An output shaft (not shown) of a motor provided in the body casing 2 is fitted in and coupled to the recessed portion 112 of the coupling gear 61 shown in FIG. 7A. When the output shaft (not shown) is rotated as the motor (not shown) is driven, the coupling gear 61 connected to the output shaft (not shown) rotates clockwise (see arrow A shown in the drawing) in a left side view. The driving force generated by the motor (not shown) is thus transferred to the coupling gear 61. Further, the development gear 58 and the supply gear 59, which both mesh with the coupling gear 61, rotate counterclockwise (see arrows B shown in the drawing) in the left side view, while the drive gear 62 meshing with the supply gear 59 rotates clockwise (see arrow C shown in the drawing) in the left side view. Namely, the driving force of the motor (not shown) is transmitted to the development gear 58 and the supply gear 59 through the coupling gear 61, and is further transmitted from the supply gear 59 to the drive gear 62. As the driving force is transmitted to the development gear 58 and the supply gear 59, respectively, the development roller 37 and the supply roller 36 rotate. Additionally, the drive gear 62 is capable of outputting the driving force transmitted thereto.

Figure 7B:
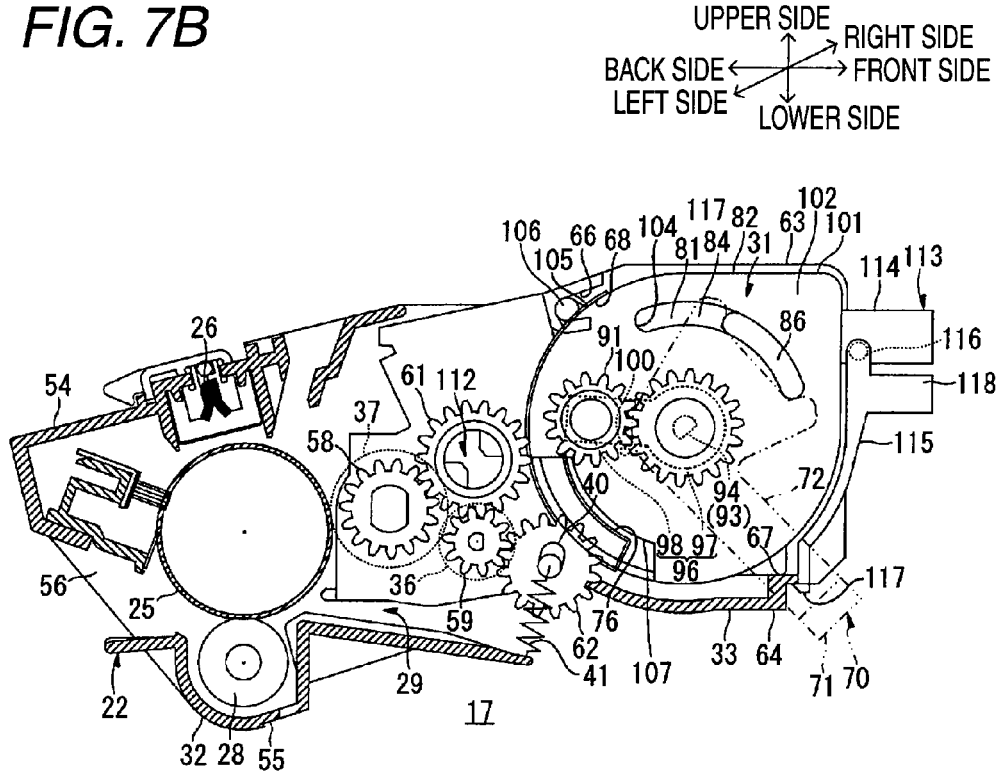
Figure 7C:
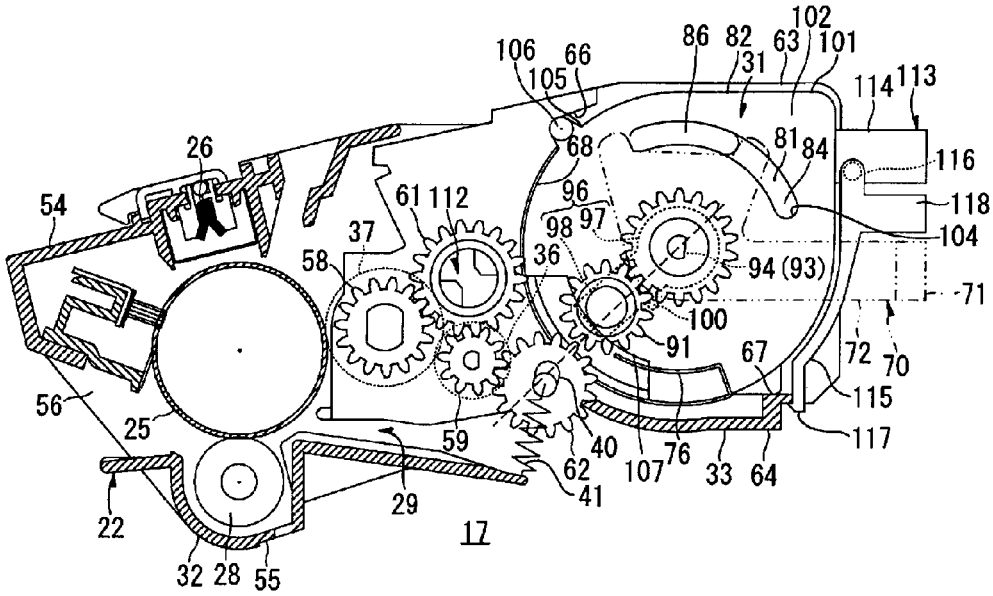
Figure 7D:
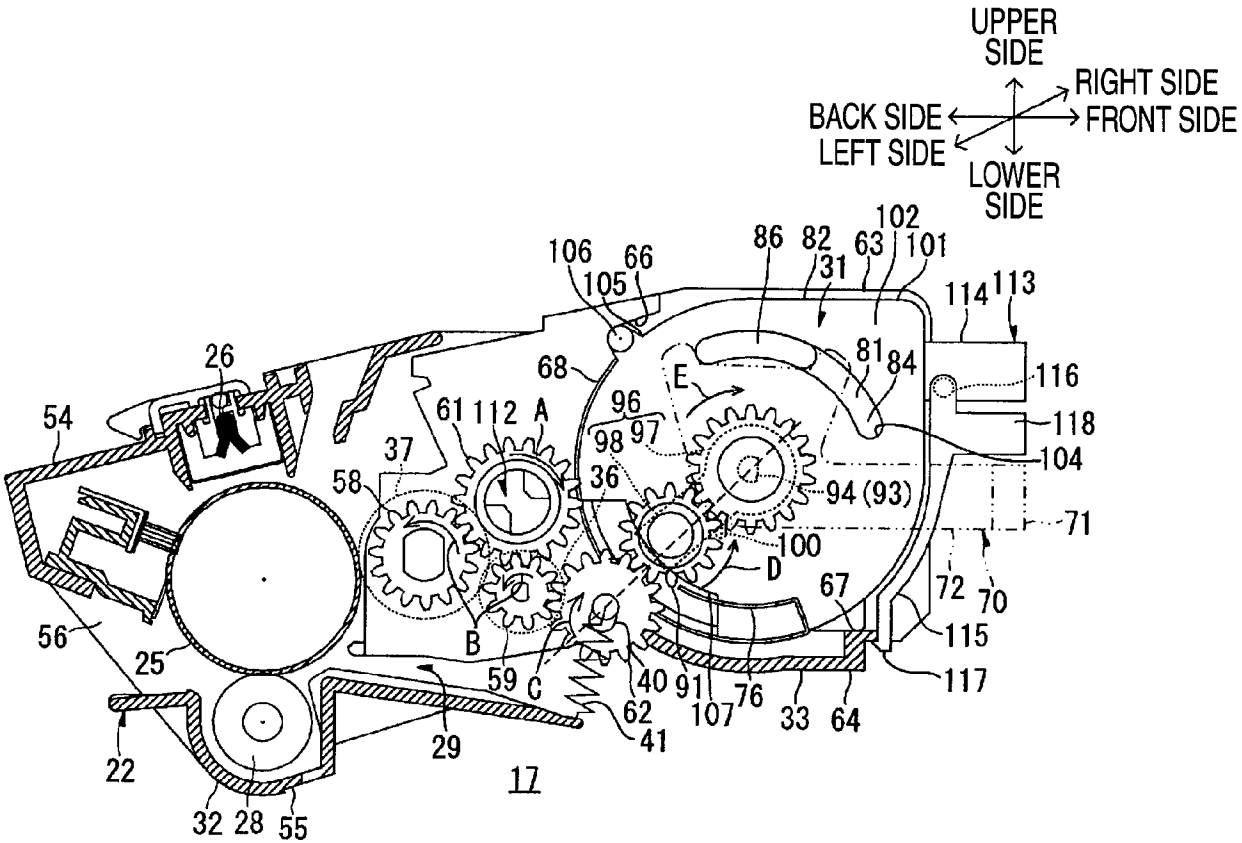

In addition, in the meshing position with the drive gear 62, the gear teeth of the supply gear 59 which rotates presses the gear teeth of the drive gear 62 upward from below. For this reason, when the supply gear 59 rotates, the entire drive gear 62 is pressed upward, so that the drive gear 62 moves to the meshing position against the pressing force of the elastic body 41, as shown in FIG. 7D. In other words, when the driving force from the rotating supply gear 59 is inputted to the drive gear 62, the drive gear 62 is pressed to the meshing position by a pressing force which is greater than the pressing force of the elastic body 41. In contrast, if the rotation of the supply gear 59 is stopped, the input of the driving force from the supply gear 59 to the drive gear 62 is stopped, and the pressing force acting on the drive gear 62 from the supply gear 59 is canceled, so that the drive gear 62 moves to the spaced-apart position by the pressing force of the elastic body 41.

As shown in FIG. 3, a curved portion conforming to the outer peripheral surface of the developer cartridge 31 is formed in the partition wall 57 midway in a vertical direction of the partition wall 57.

The aforementioned frame-side passage port 34 is formed in a substantially central portion in the widthwise direction of the curved portion of the partition wall 57. The frame-side passage port 34 has a substantially rectangular shape elongated in the widthwise direction.

(1-2) Cartridge Housing Part

Figure 5:
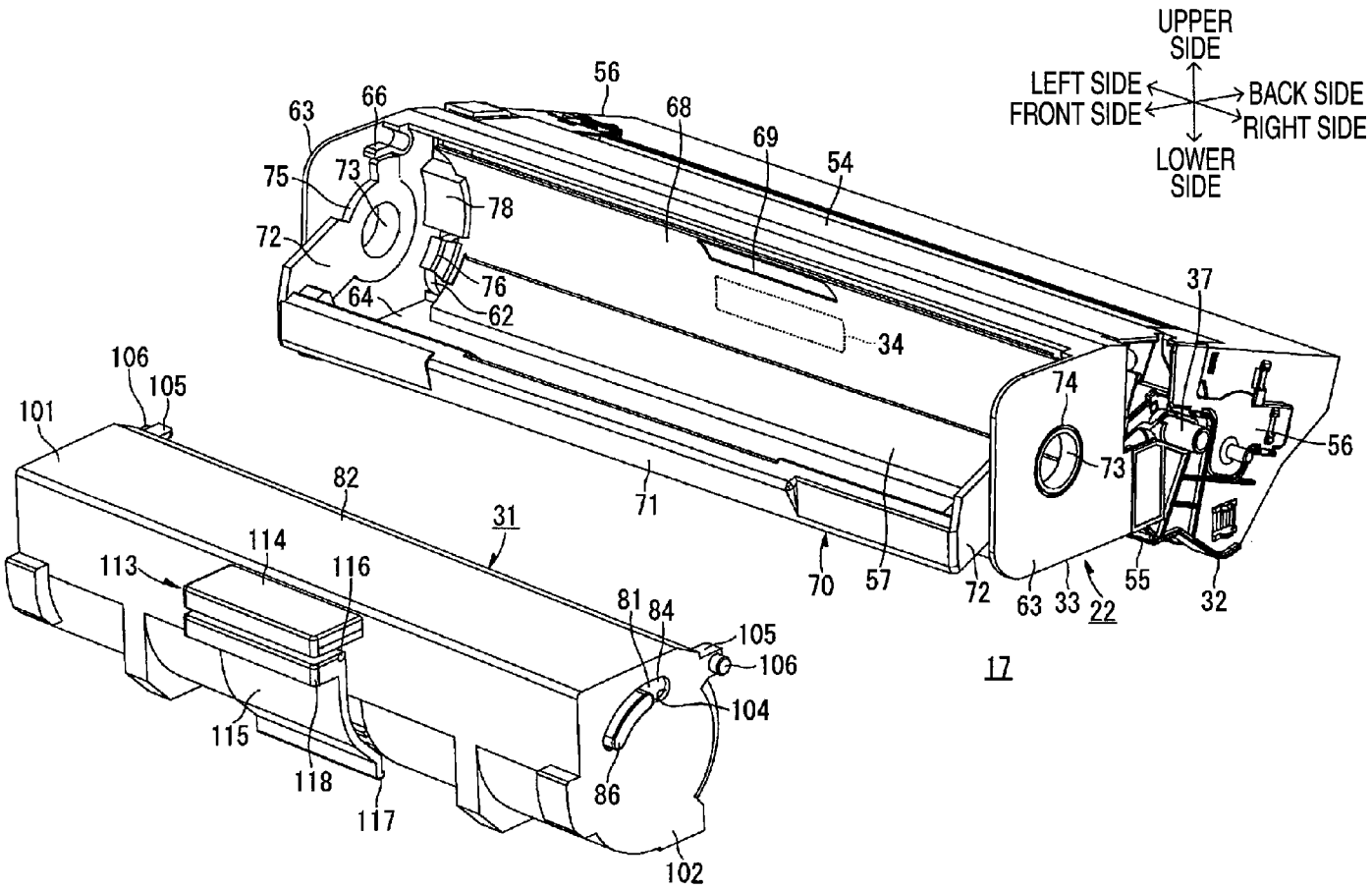
FIG. 5 is an exemplary perspective view of the process cartridge of FIG. 2 as viewed from the front right side, in a state in which the developer cartridge is detached from the process frame.

As shown in FIG. 5, the cartridge housing part 33 has the two side plates 63 and a bottom plate 64. The two side plates 63 and the bottom plate 64 are continuous to the two side walls 56 and the bottom wall 55 of the developing part 32, and are formed integrally therewith.

A shutter guide 78 and an upper fixing part 66 are provided on a widthwise inner surface of each side plate 63.

The shutter guide portion 78 has a protruding shape in which the shutter guide portion 78 bulges inwardly from the widthwise inner surface of the side plate 63 in a rear end portion of the side plate 63, and is disposed oppositely to the curved portion of the partition wall 57 with a slight interval therewith in the front-back direction. The shutter guide portion 78 is formed in a curved shape with a substantially identical curvature to that of the curved portion of the partition wall 57. The aforementioned drive gear 62 is disposed below the left shutter guide portion 78.

The upper fixing part 66 has a protruding shape in which the upper fixing part 66 bulges inwardly from the widthwise inner surface of the side plate 63 in a rear-side upper end portion of the side plate 63. Specifically, the upper fixing part 63 in a side view has a substantially U-shape in which the upper fixing part 63 is recessed diagonally backward and downward.

A lower fixing part 67 which slightly projects forward is formed in the bottom plate 64 at a substantially central portion of a front end of the bottom plate 64 (see FIG. 3).

In addition, a shutter 68 for opening and closing the frame-side passage port 34 is provided in the cartridge housing part 33.

The shutter 68 has a substantially rectangular thin plate shape extending in the widthwise direction, and is formed in a curved shape with a substantially identical curvature to that of the curved portion of the partition wall 57. The shutter 68 is formed in such a manner as to extend between the shutter guide portions 78 in the widthwise direction and extend slightly longer than each shutter guide portion 78 in the vertical direction. A shutter opening 69 which is capable of opposing the frame-side passage port 34 is formed in the shutter 68. In addition, a protective cover 76 is integrally provided on a lower end portion of a left end portion of the shutter 68. The protective cover 76 has a thin plate shape in which the protective cover 76 extends forward and then bends leftward.

As shown in FIG. 3, the shutter 68 is disposed oppositely to the curved portion of the partition wall 57, and the widthwise two end portions of the shutter 68 are slidably sandwiched between the partition wall 57 and the respective shutter guide portion 78.

As a result, the shutter 68 is supported vertically swingably between an open position (see FIGS. 2, 7C, and 7D) for opening the frame-side passage port 34 and a closed position (see FIGS. 3, 5, 7A, and 7B) for closing the frame-side passage port 34.

When the shutter 68 is at the open position, the frame-side passage port 34 opposes the shutter opening 69 and is open to the outside (front side), as shown in FIG. 2. In addition, as shown in FIGS. 7C and 7D, since the protective cover 76 is disposed in such a manner as to be spaced apart slightly diagonally forward and downward from the drive gear 62, the drive gear 62 is exposed to the front side.

When the shutter 68 is at the closed position, the frame-side passage port 34 is closed from the front side by that portion of the shutter 68 located below the shutter opening 69, as shown in FIG. 3. In addition, as shown in FIGS. 7A and 7B, since the protective cover 76 is disposed in proximity to the front side of the drive gear 62, the drive gear 62 is covered from the front side by the protective cover 76.

In addition, as shown in FIG. 5, a swing arm 70 is provided in the cartridge housing part 33. The swing arm 70 has a substantially U-shape in a plan view. The swing arm 70 integrally has a grip lever 71 extending axially and a pair of arm side plates 72 respectively extending from widthwise both end portions of the grip lever 71 toward the back side.

A boss 73 projecting widthwise outward is provided at a rear end portion of each arm side plate 72. Each boss 73 is rotatably supported in a round hole 74 formed in the corresponding side plate 63.

In addition, a receiving recess 75 which is notched so as to be recessed downward is formed at an upper end of a rear end portion of the respective arm side plate 72.

By using the boss 73 of each arm side plate 72 as a fulcrum, the swing arm 70 swings between the pressing releasing position (see FIGS. 3 and 5) in which a lower end of the respective arm side plate 72 comes into contact with a front end of the bottom plate 64 and a pressing position (see FIGS. 2 and 4) for pressing the developer cartridge 31 from the front side when the developer cartridge 31 is accommodated in the cartridge housing part 33.

(2) Developer Cartridge

Figures 8A, 8B, 8C, 8D:
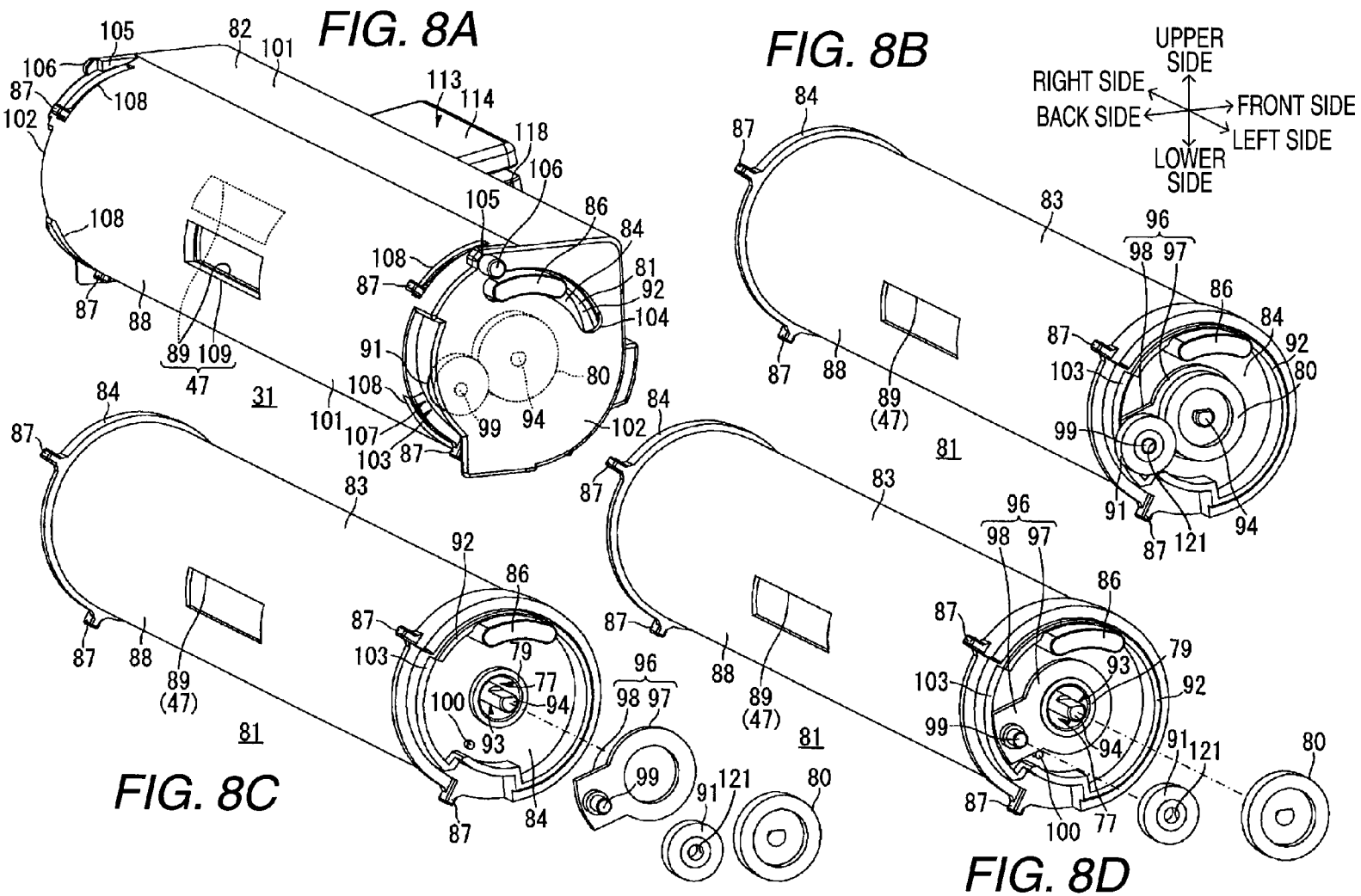
FIG. 8A is a perspective view of a developer cartridge according to an exemplary embodiment of the present invention, as viewed from a back left side.
FIG. 8B is a perspective view of an inside housing of the developer cartridge of FIG. 8A.
FIG. 8C is a first schematic perspective view of the inside housing shown in FIG. 8B.
FIG. 8D is a second schematic perspective view of the inside housing shown in FIG. 8B.

FIG. 8A is a perspective view of a developer cartridge according to an exemplary embodiment of the present invention, as viewed from a back left side. FIG. 8B is a perspective view of an inside housing of the developer cartridge of FIG. 8A. FIG. 8C is a first schematic perspective view of the inside housing shown in FIG. 8B. FIG. 8D is a second schematic perspective view of the inside housing shown in FIG. 8B.

As shown in FIGS. 8A to 8D, the developer cartridge 31 includes an inside housing 81 for accommodating developer and an outside housing 82 for accommodating the inside housing 81. The inside housing 81 functions as an example of a second housing. The outside housing 82 functions as an example of a first housing. The inside housing 81 and the outside housing 82 also function as examples of cartridge housings.

(2-1) Inside Housing

As shown in FIG. 8B, the inside housing 81 integrally includes an inner peripheral wall 83 extending in the widthwise direction and having a substantially hollow cylindrical shape, as well as a pair of disk-shaped inner side walls 84 for closing widthwise the end portions of the inner peripheral wall 83.

A sliding projection 86 is provided on the upper side of each inner side wall 84. The sliding projection 86 has a circular arc shape (i.e., a circular arc shape with a central angle of about 60°) in a side view, which conforms to an outer peripheral surface of the inner side wall 84, and is provided in such a manner as to project from the inner side wall 84 outward in the widthwise direction.

Each inner side wall 84 has a pair of clamping projections 87 provided in a rear side portion of the inner side wall 84 in such a manner as to project radially from a peripheral end face of the inner side wall 84. The pair of clamping projections 87 are disposed on the peripheral end face of the inner side wall 84 in such a manner as to be circumferentially spaced apart with an interval (an interval corresponding to the circumferential length of the shutter 68) therebetween.

As shown in FIG. 8C, a through hole 77 having a circular shape in a side view and extending through the left inner side wall 84 is formed in a circle center portion of that inner side wall 84. Further, an annular supporting rib 79 projecting leftward (outward in the widthwise direction) along a peripheral edge of the through hole 77 is integrally provided on the inner side wall 84. Furthermore, a leftwardly projecting cylindrical projection (referred to as a holding projection 100) is integrally provided on the left inner side wall 84 on a side of the supporting rib 79 which is opposite from the side where the sliding projection 86 is provided.

In the inner peripheral wall 83, an inside passage port 89 is formed in a surrounded portion 88 surrounded by two pairs of clamping projections 87 (i.e., four clamping projections 87) arranged on the widthwise two sides, respectively.

The inner passage port 89 is formed in a substantially upper portion of the surrounded portion 88. During image formation, the inner passage port 89 is opposed to the frame-side passage port 34, as shown in FIG. 2.

The agitator 93 is provided in the inside housing 81. The agitator 93 has an axially extending agitator shaft 94, as well as an agitating blade 95 extending radially outward from that agitator shaft 94. The agitator shaft 94 functions as an example of a rotating shaft.

The agitator shaft 94 is a round bar having a smaller diameter than the through hole 77, an outer peripheral surface of a left end portion of the agitator shaft 94 is locally notched, as shown in FIG. 8C, and a cross section of the left end portion is substantially semicircular. In the state in which the agitator 93 is accommodated in the inside housing 81, the left end portion of the agitator shaft 94 is exposed from the through hole 77 to the left side of the left inner side wall 84. An agitator gear 80 as an example of an agitation gear is mounted on a left end portion of the agitator shaft 94.

The agitator gear 80 is a gear whose circle center is the agitator shaft 94, and gear teeth are formed on its outer peripheral surface (i.e., an end face in a perpendicular direction which is perpendicular to the widthwise direction) A through hole having a substantially identical shape to that of the cross-sectional shape (i.e., a substantially semicircular shape) of the left end portion of the agitator shaft 94 is formed in a circle center portion of the agitator gear 80. As the left end portion of the agitator shaft 94 is fitted in the through hole, the agitator gear 80 is incapable of relatively rotating with respect to the agitator shaft 94 (see FIGS. 8B and 8D). In addition, although not shown, a circular tube portion, which has a diameter smaller than the through hole 77 and larger than the agitator shaft 94 and projects in a direction of approaching the left inner side wall 84 (i.e., rightward), is formed on the face (i.e., right face in FIG. 8C) of the agitator gear 80 which opposes the left inner side wall 84. The interior of this circular tube portion communicates with the through hole of the agitator gear 80. When the agitator gear 80 is mounted on the agitator shaft 94, the circular tube portion is inserted through the through hole 77. Specifically, the circular tube portion is loosely fitted in the through hole 77 so as to be disposed between the supporting rib 79 and the agitator shaft 94, and the agitator gear 80 and the left end portion of the agitator shaft 94 are supported relatively unrotatably with respect to the supporting rib 79. In addition, the right end portion of the agitator shaft 94 is rotatably supported by the right inner side wall 84. Thus, the agitator shaft 94 is rotatably supported by the inner side walls 84.

A link lever 96 as an example of a supporting member is inserted between the left inner side wall 84 and the agitator gear 80 in the widthwise direction (see FIGS. 8B and 8D). The link lever 96 has a thin plate shape integrally having a fitting portion 97 and a supporting portion 98. The fitting portion 97 in a side view has a substantially annular shape in which a through hole having a slightly larger diameter than the supporting rib 79 is formed. The supporting portion 98 has a substantially rectangular shape extending radially outward from one peripheral portion of the fitting portion 97. A cylindrical supporting shaft 99 projecting leftward along the widthwise direction is integrally provided on the supporting portion 98. As the through hole of the fitting portion 97 of the link lever 96 is fitted over the supporting rib 79, the link lever 96 is supported rotatably about the supporting rib 79 (see FIG. 8D). In addition, in a state in which the inner passage port 89 is oriented toward the back side, the supporting portion 98 is engaged with the holding projection 100 from the upper side. In this state, the posture of the link lever 96 is held by the holding projection 100 such that the supporting portion 98 is oriented toward the back side (see FIG. 8D).

Referring to FIGS. 8C and 8D, a transmission gear 91 is rotatably attached to the supporting shaft 99 of the link lever 96. The transmission gear 91 is a gear whose circle center is the supporting shaft 99, and gear teeth are formed on an outer peripheral surface thereof (i.e., an end face in the perpendicular direction which is perpendicular to the widthwise direction). In the transmission gear 91, a round hole (referred to as a gear through hole 121) extending through the transmission gear 91 in the widthwise direction is formed in a circle center (rotational center) of the transmission gear 91. The gear through hole 121 has a slightly larger diameter than the supporting shaft 99. As the supporting shaft 99 is inserted through the gear through hole 121, the transmission gear 91 is rotatably supported by the supporting shaft 99. In a state in which the transmission gear 91 is supported by the supporting shaft 99, the transmission gear 91 meshes with the agitator gear 80 from the back side (see FIG. 8B). In addition, in the state in which the transmission gear 91 is meshed with the agitator gear 80, the transmission gear 91 together with the link lever 96 is rotatable about the supporting rib 79. In other words, the transmission gear 91 in the state in which it is meshed with the agitator gear 80 is supported by the link lever 96 movably with respect to the agitator gear 80. In addition, the transmission gear 91 relatively moves with respect to the inside housing 81 when the transmission gear 91 rotates about the supporting rib 79.

A substantially annular rib (referred to as an annular rib 92) is integrally provided on a left side surface of the left inner side wall 84 in such a manner as to extend substantially along an outer peripheral edge of the left inner side wall 84 and project leftward through a radially outer position of the sliding projection 86. A back side portion of the annular rib 92 which is a portion close to the transmission gear 91 is notched (this notched portion will be referred to as an inner notch 103; see FIG. 8A), and gear teeth of the transmission gear 91 are exposed from the inner notch 103 toward the back side (see FIG. 8B). The transmission gear 91 and the link lever 96 are rotatable about the supporting rib 79 in a range in which the transmission gear 91 is exposed from the inner notch 103.

(2-2) Outside Housing

As shown in FIG. 8A, the outside housing 82 is formed with a slightly larger size in the widthwise direction and in the radial direction than the inside housing 81. The outside housing 82 integrally includes an outer peripheral wall 101 having a substantially hollow cylindrical shape and extending in the widthwise direction and a pair of outer side walls 102 having a substantially disk shape for closing widthwise both end portions of the outer peripheral wall 101.

It should be noted that, as for the outer peripheral wall 101, outer peripheral surfaces on an upper side of the outer peripheral wall 101 and an upper portion of a front side of the outer peripheral wall 101 are formed in a flat shape, but an inner peripheral surface of the outer peripheral wall 101 is formed in a circular shape in cross section (see FIG. 2).

A sliding hole 104, through which the sliding projection 86 can be inserted, is formed in the outer side wall 102 in the vicinity of an upper peripheral edge of the outer sidewall 102. The sliding hole 104 is disposed in such a manner as to oppose the sliding projection 86 in the widthwise direction. The sliding hole 104 in a side view has a circular arc shape which is longer than the sliding projection 86.

An upper to-be-fixed portion 105 projecting slightly toward the back side is formed on a peripheral end face of the outer side wall 102 above the rear end portion of the sliding hole 104. A positioning boss 106 projecting outward in the widthwise direction is provided on a rear end portion of the upper to-be-fixed portion 105.

A plurality of, e.g., four, elongated holes 108, through which two pairs of clamping projections 87 (i.e., four clamping projections 84) are respectively inserted, are formed in the outer peripheral wall 101 at the widthwise end portions, respectively, of the outer peripheral wall 101. Each elongated hole 108 is arranged so as to oppose the respective clamping projection 87 in the radial direction. The elongated hole 108 has a substantially rectangular shape extending in the vertical direction in a rear view, and is formed with a length corresponding to the swinging range between the open position and the closed position of the shutter 68.

An outer passage port 109, which comprises a portion of the cartridge-side passage port 47, is formed in the outer peripheral wall 101 between the two pairs of elongated holes 108 (i.e., between the vertical pair of elongated holes 108 on the left side and the vertical pair of elongated holes 108 on the right side). During image formation, the outer passage port 109 opposes both the inner passage port 89 and the frame-side passage port 34 (see FIG. 2).

In a connecting portion between the outer peripheral wall 101 and the left outer side wall 102, a portion of the left outer side wall 102 in the vicinity of the lower left elongated hole 108 is noted (this portion will be referred to as an outer notch 107) so as to continue to this elongated hole 108. The outer notch 107 functions as an example of an exposing portion.

A grip portion 113 is provided on the front side of the outer peripheral wall 101 in a substantially central portion thereof.

As shown in FIG. 2, the grip portion 113 has a substantially rectangular upper grip plate 114 projecting from the upper side of the outer peripheral wall 101 toward the front side and a retaining arm 115 having a substantially J-shape in a side view and extending downward below the upper grip plate 114. An upper end portion of the retaining arm 115 is swingably supported by a supporting shaft 116 provided below the upper grip plate 114. A retaining pawl 117 for retaining the lower fixing part 67 is provided at a lower end portion of the retaining arm 115. A substantially rectangular lower grip plate 118 projecting toward the front side is integrally provided in the vicinity of an upper end portion of the retaining arm 115. The lower grip plate 118 is disposed in such a manner as to extend substantially parallel in spaced-apart relation to the upper grip plate 114.

A compression spring (not shown) is interposed between the upper grip plate 114 and the lower grip plate 118 to urge the upper grip plate 114 and the lower grip plate 118 to move away from each other.

(2-3) Relative Arrangement of Inside Housing and Outside Housing and Relative Movement of Inside Housing The inside housing 81 is rotatably accommodated in the outside housing 82.

Specifically, the outer peripheral surface of the inner peripheral wall 83 is fitted in such a manner as to be slidable in the circumferential direction with respect to the inner peripheral surface of the outer peripheral wall 101. Accordingly, the circle center Y of the inner peripheral surface of the outer peripheral wall 101 and the axial center of the agitator shaft 94 are coincident with each other in a side view.

In addition, as shown in FIG. 8A, the transmission gear 91 and the agitator gear 80 are disposed between the left inner side wall 84 and the left outer side wall 102, i.e., between the inside housing 81 and the outside housing 82.

A corresponding one of the sliding projections 86 is inserted through the sliding hole 104, and the sliding projection 86 projects from the sliding hole 104 outward in the widthwise direction. A corresponding one of the clamping projections 87 is inserted through the elongated hole 108, and the clamping projection 87 projects from the elongated hole 108 outward in the radial direction.

Referring to FIG. 2, the inside housing 81 is allowed to undergo relative rotation with respect to the outside housing 82 by using as a fulcrum the circle center of the inner peripheral surface of the outer peripheral wall 101 between the closed position (see FIGS. 7A and 7B) in which the inner passage port 89 does not oppose the outer passage port 109 and the open position (see FIGS. 2, 7C, 7D, and 8A) in which the inner passage port 89 opposes the outer passage port 109. The inner passage port 89 is opened and closed by the rotation of the inside housing 81 between the closed position and the open position, as will be described later.

Referring to FIG. 8A, when the inside housing 81 is at the closed position, each sliding projection 86 is disposed at the front end portion of the respective sliding hole 104, each clamping projection 87 is disposed at an upper end portion of the respective elongated hole 108, and the inner passage port 89 (indicated by a dashed line in FIG. 8A) is disposed upwardly of the outer passage port 109. Further, the inner passage port 89 is closed by a portion of the outer peripheral wall 101 located upwardly of the outer passage port 109. In other words, the inner passage port 89 is closed by the outside housing 82. In addition, as shown in FIGS. 7A and 7B, the supporting portion 98 of the link lever 96 engages the holding projection 100 from the upper side and projects toward the back side (specifically, diagonally backward and upward). The position of the transmission gear 91 being supported by the supporting portion 98 in this posture will be referred to as a spaced-apart position. In other words, the transmission gear 91 is held at the spaced-apart position by the holding projection 100 engaged with the link lever 96.

Further, as shown in FIG. 8A, the inside housing 81 is relatively rotated with respect to the outside housing 82 toward the open position side, i.e., in a direction (downward) in which the inner passage port 89 is oriented toward the outer passage port 109. Consequently, each sliding projection 86 slides in the respective sliding hole 104 from a front end portion toward a rear end portion, and each clamping projection 87 slides in the respective elongated hole 108 from an upper end portion toward a lower end portion. At this time, as shown in FIGS. 7C and 7D, since the holding projection 100 rotates downward integrally with the inside housing 81, the link lever 96 rotates downward by the self-weight of the link lever 96 and the transmission gear 91 in a state in which the supporting portion 98 is engaged with the holding projection 100. Thus, the supporting portion 98 is lowered, and the transmission gear 91, which was at the spaced-apart position, is also lowered. Thus, the holding projection 100 releases the holding of the transmission gear 91 at the spaced-apart position in interlocked relation to the rotation of the inside housing 81 (i.e., to the opening operation of the inner passage port 89).

Further, as shown in FIG. 8A, each sliding projection 86 reaches the rear end of the respective sliding hole 104, and each clamping projection 87 reaches the lower end of the respective elongated hole 108, whereupon the inside housing 81 is disposed at the open position.

When the inside housing 81 is disposed at the open position, each sliding projection 86 is disposed at the rear end portion of the respective sliding hole 104, each clamping projection 87 is disposed at the lower end portion of the respective elongated hole 108, and the inner passage port 89 opposes the corresponding outer passage port 109, allowing the inner passage port 89 and the outer passage port 109 to communicate with each other and to be opened. In other words, the inner passage port 89 is opened by the outside housing 82. In addition, the supporting portion 98 of the link lever 96 projects toward the back side (specifically, diagonally backward and downward) (see FIGS. 7C and 7D). The position of the transmission gear 91 being supported by the supporting portion 98 in this posture will be referred to as a meshed position. When the transmission gear 91 is at the meshed position, the inner notch 103 and the outer notch 107 are coincident with each other in the radial direction, and the transmission gear 91 is exposed diagonally backward and downward through the inner notch 103 and the outer notch 107. Thus, the meshed position (see FIGS. 7C and 7D) is a downwardly spaced-apart position when viewed from the spaced-apart position (see FIGS. 7A and 7B). Further, the transmission gear 91 is movable between the meshed position and the spaced-apart position.

Meanwhile, in the state in which the inside housing 81 is at the open position, the inside housing 81 is relatively rotated with respect to the outside housing 82 toward the closed position side, i.e., in a direction (upward) in which the inner passage port 89 moves away from the outer passage port 109. Consequently, each sliding projection 86 slides in the respective sliding hole 104 from a rear end portion toward a front end portion, and each clamping projection 87 slides in the respective elongated hole 108 from a rear end portion toward a front end portion. At this time, since the holding projection 100 rotates upward integrally with the inside housing 81, the link lever 96 is rotated upward as the supporting portion 98 is pressed upward by the holding projection 100. In conjunction with this, the supporting portion 98 rises, and the transmission gear 91 also rises (see FIG. 7B).

Further, when each sliding projection 86 reaches the front end of the respective sliding hole 104, and each clamping projection 87 reaches the upper end of the respective elongated hole 108, the inside housing 81 is disposed at the closed position, as shown in FIG. 7B. At this time, the holding projection 100 continues to be engaged with the supporting portion 98, and the transmission gear 91 is disposed at the spaced-apart position. Thus, the transmission gear 91 is held in the spaced-apart position in interlocked relation to the rotation of the inside housing 81 to the closed position (i.e., to the closing operation of the inner passage port 89).

(3) Installation and Removal of Developer Cartridge with Respect to Process Frame (3-1) Installation of Developer Cartridge into Process Frame To install the developer cartridge 31 into the process frame 22, the upper grip plate 114 and the lower grip plate 118 are gripped in directions in which they approach each other against the urging force of a compression spring (not shown), as shown in FIGS. 5 and 7A. Then, the developer cartridge 31 (i.e., the developer cartridge 31 with the inside housing 81 disposed at the closed position) is accommodated in the cartridge housing part 33 (i.e., the cartridge housing part 33 with the shutter disposed at the closed position and the swing arm 70 disposed at the pressing releasing position). The direction in which the developer cartridge 31 is installed into the process frame 22 and the direction in which the developer cartridge 31 is removed from the process frame 22 are the front-back direction, i.e., a direction perpendicular to the widthwise direction. At this time, the transmission gear 91 is at the spaced-apart position (see FIG. 7A). Then, in the process frame 22, the drive gear is covered by the protective cover 76 (see FIG. 7A).

The developer cartridge 31 accommodated in the cartridge housing part 33 is placed on the bottom plate 64. At this time, each positioning boss 106 is fitted to the respective upper fixing part 66, and each sliding projection 86 is fitted in the respective receiving recess 75, as shown in FIG. 4. Additionally, the two pairs of clamping projections 87 on widthwise two sides respectively clamp the upper ends and the lower ends of the widthwise both end portions of the shutter 68, as shown in FIG. 2.

Subsequently, when the clamping of the upper grip plate 114 and the lower grip plate 118 is released, the retaining arm 115 is swung by the urging force of the compression spring, so that the retaining pawl 117 is retained at the lower fixing part 67, thereby completing the installation of the developer cartridge 31 into the process frame 22. The outside housing 82 is fixed in the cartridge housing part 33 since the positioning boss 106 is fitted to the upper fixing part 66 (see FIG. 5), and the retaining pawl 117 is retained at the lower fixing part 67.

At this time, as shown in FIG. 7B, the transmission gear 91 at the spaced-apart position comes into contact with the protective cover 76 from the upper side and is disposed in such a manner as to be spaced vertically apart from the drive gear 62 covered by the protective cover 76. Thus, the transmission gear 91 is held at the spaced-apart position by not only the holding projection 100 but also the protective cover 76.

Further, the swing arm 70 is swung from the pressing releasing position (see FIG. 3) to the pressing position (see FIG. 2). This movement of the swing arm 70 causes each sliding projection 86 fitted in the respective receiving recess 75 to slide in the respective sliding hole 104 backward in conjunction with the swinging motion of each arm side plate 72 and to be disposed at the rear end portion of the respective sliding hole 104 (see FIG. 4). In conjunction with the swinging motion, the two pairs of clamping projections 87 on the widthwise two sides, while clamping the shutter 68, slide downward in the respective elongated holes 108 and are disposed at the lower end portions of the elongated holes 108 (see FIG. 8A).

Accordingly, the inside housing 81 is disposed at the open position, and the inner passage port 89 opposes the outer passage port 109 substantially in the horizontal direction, such that the inner passage port 89 and the outer passage port 109 are made to communicate with each other. In addition, the shutter 68 is lowered and disposed at the open position, and the frame-side passage port 34 opposes the shutter opening 69 and the cartridge-side passage port 47, comprising the inner passage port 89 and the outer passage port 109, substantially in the horizontal direction, such that the inner passage port 89 and the outer passage port 109 are made to communicate with each other. Here, as for the transmission gear 91 which was in contact with the protective cover 76 from the upper side at the spaced-apart position (see FIG. 7B), a state of contact of the transmission gear 91 with the protective cover 76 is canceled as the protective cover 76 is lowered in conjunction with the movement (lowering) of the shutter 68 to the open position. Accordingly, it becomes possible for the transmission gear 91 to move (to be lowered) to the meshing position. In other words, the protective cover 76 releases the holding of the transmission gear 91 at the spaced-apart position in interlocked relation to the rotation of the inside housing 81 to the opening position (i.e., the opening operation of the inner passage port 89). Then, as the protective cover 76 is lowered and releases the holding of the transmission gear 91 at the spaced-apart position, the protective cover 76 exposes the drive gear 62 to the front side (see FIGS. 7C and 7D).

Next, a description will be given of the process in which the transmission gear 91 and the drive gear 62 are meshed with each other in correspondence with the movement of the inside housing 81 from the closed position to the open position.

In conjunction with the movement of the inside housing 81 from the closed position to the open position, the transmission gear 91 is lowered from the spaced-apart position to the meshing position, as described above. Then, the transmission gear 91 which was lowered to the meshing position continues to be disposed in such a manner as to be spaced apart vertically (diagonally forward and upward) from the drive gear 62 exposed at the spaced-apart position, as shown in FIG. 7C.

During the image formation, as the driving force of the aforementioned motor (not shown) is transmitted to rotate the supply gear 59, the drive gear 62 which was at the spaced-apart position is pressed by the supply gear 59 and moves to the meshing position, and comes into contact with the transmission gear 91 from the lower side.

At this juncture, the transmission gear 91 and the drive gear 62 are smoothly meshed with each other, a shown in FIG. 7D, unless tooth tips of their gear teeth collide.

In contrast, if tooth tips of their gear teeth collide, the drive gear 62 is temporarily lowered slightly so as to retreat from the transmission gear 91, while being guided by the guide hole 40. Namely, the drive gear 62 moves to the spaced-apart position side. Then, the drive gear 62 is raised again by the pressing force of the supply gear 59 which rotates, and in the meshing position the drive gear 62 is smoothly meshed with the transmission gear 91, as shown in FIG. 7D, unless tips of the gear teeth of the transmission gear 91 and tips of the gear teeth of the drive gear 62 collide with each other.

In addition, in a case where the drive gear 62 does not retreat when the tips of their gear teeth collided, the transmission gear 91 is momentarily brought to a standstill (standby) with its tooth tips brought into slight contact with tooth tips of the drive gear 62, but is quickly meshed with the drive gear 62 by the rotation of the drive gear 62, as shown in FIG. 7D.

Thus, when the drive gear 62 and the transmission gear 91 mesh with each other, the aforementioned driving force is outputted from the drive gear 62 and is sequentially transmitted to the agitator gear 80 and the agitator shaft 94. Consequently, the transmission gear 91 rotates counterclockwise (see arrow D shown in the drawing) in the left side view. Further, the agitator gear 80 and the agitator shaft 94 rotate clockwise (see arrow E shown in the drawing) in the left side view. As a result, the agitator 93 rotates in the same direction as the agitator gear 80, and the developer in the inside housing 81 is agitated. Namely, the driving force is transmitted to the agitator 93. Further, by the agitation by the agitator 93 (specifically, the agitating blade 95), the developer in the inside housing 81 at the open position passes through the inner passage port 89, the outer passage port 109, the shutter opening 69, and the frame-side passage port 34 along a substantially horizontal direction, and is supplied into the developing part 32, as shown in FIG. 2. The developer supplied into the developing part 32 is supplied sequentially to the supply roller 36, the development roller 37, and the photoconductive drum 25, as described above.

(3-2) Removal of Developer Cartridge from Process Frame

To remove the developer cartridge 31 from the process frame 22, the driving of the motor (not shown) is first stopped to stop the rotation of the supply gear 59, and the drive gear 62 is thereby moved to the spaced-apart position to cancel the meshing state between the drive gear 62 and the transmission gear 91, as described above (see FIG. 7C). Then, the swing arm 70 is swung from the pressing position to the pressing releasing position.

When the swing arm 70 is swung from the pressing position to the pressing releasing position, each sliding projection 86 (see FIG. 4) fitted in the respective receiving recess 75 slides forward in the respective sliding hole 104 (see FIG. 8A) in conjunction with the swinging motion of each arm side plate 72 and is disposed at the front end portion of the respective sliding hole 104. Then, the two pairs of clamping projections 87 on the widthwise both sides, while holding the shutter 68, slide upward in the respective elongated holes 108 and are disposed at the upper end portions of the elongated holes 108.

As a result, the inside housing 81 is disposed at the closed position, and the inner passage port 89 is closed by opposing the outer peripheral wall 101 (see the dotted-line portion in FIG. 8A). In addition, the shutter 68 is disposed at the closed position, and the frame-side passage port 34 is closed by opposing the shutter 68 (see FIG. 3).

Here, if the inside housing 81 is moved from the open position to the closed position, the holding projection 100 which rotates upward presses the supporting portion 98 upward from the state shown in FIG. 7C. Further, the protective cover 76 which is raised in conjunction with the movement of the shutter 68 to the closed position presses the transmission gear 91 upward. As a result, the transmission gear 91 which was at the meshing position is raised, so that the transmission gear 91 is upwardly moved away from the drive gear 62 and is disposed at the spaced-apart position, as shown in FIG. 7B. Further, as described above, since the holding projection 100 continues to be engaged with the supporting portion 98, and the protective cover 76 continues to be in contact with the transmission gear 91, as described above, the transmission gear 91 is held at the spaced-apart position. Namely, the transmission gear 91 is held at the spaced-apart position by the holding projection 100 and the protective cover 76 in interlocked relation to the rotation of the inside housing 81 to the closed position (i.e., the closing operation of the inner passage port 89). In addition, when the transmission gear 91 is at the spaced-apart position, the shutter 68 is at the closed position, and the drive gear 62 at the spaced-apart position is covered by the protective cover 76.

Further, if the upper grip plate 114 and the lower grip plate 118 shown in FIG. 2 are clamped in the direction in which they approach each other, the retention of the retaining pawl 117 with respect to the lower fixing part 67 is canceled. Subsequently, the developer cartridge 31 as it is is pulled out from the cartridge housing part 33 toward the front side, as shown in FIG. 5. This cancels the fitting of the positioning boss 106 to the upper fixing part 66, the fitting of the sliding projection 86 in the receiving recess 75, and the clamping of the shutter 68 by the clamping projections 87 (see FIG. 2), so that the developer cartridge 31 is disengaged from the process frame 22.

In this process cartridge 17, when the developer cartridge 31 is installed in the process frame 22, and the drive gear 62 of the process frame 22 and the transmission gear 91 of the developer cartridge 31 are meshed with each other, as shown in FIG. 7D, the driving force is transmitted from the drive gear 62 to the agitator 93 through the transmission gear 91. This makes it possible to rotate the agitator 93 to agitate the developer.

Here, the developer cartridge 31 is installed in and removed from the process frame 22 along the front-back direction (in the perpendicular direction which is perpendicular to the widthwise direction). In the transmission gear 91, gear teeth are formed on its end face in the perpendicular direction, and in the drive gear 62 as well, gear teeth are formed on its end face in the perpendicular direction. In this case, at the time of installing the developer cartridge 31 to the process frame 22, there is a possibility of collision between tooth tips of the transmission gear 91 and tooth tips of the drive gear 62.

However, the drive gear 62 is movable between the meshing position (see FIG. 7D) for meshing with the transmission gear 91 and the spaced-apart position (see FIGS. 7A to 7C) spaced apart from the meshing position. For this reason, if the drive gear 62 is kept disposed at the spaced-apart position, the collision between tooth tips of the transmission gear 91 and tooth tips of the drive gear 62 can be prevented when the developer cartridge 31 is installed to the process frame 22, as shown in FIG. 7A. In addition, even if the drive gear 62 is not disposed at the spaced-apart position, in the case where the tooth tips of the transmission gear 91 and the tooth tips of the drive gear 62 have collided, the drive gear 62 is able to retreat to the spaced-apart position side, so that it is possible to alleviate the shock at the time of the collision. Then, as shown in FIG. 7D, as the drive gear 62 is moved to the meshing position upon completion of the installation of the developer cartridge 31 to the process frame 22, the drive gear 62 and the transmission gear 91 can be reliably meshed with each other.

Consequently, the transmission gear 91 of the developer cartridge 31 and the drive gear 62 of the process frame 22 can be smoothly meshed without being damaged, so that the developer cartridge 31 can be smoothly installed in the process frame 22.

In addition, when the driving force is inputted from the supply gear 59, the drive gear 62 moves to the meshing position (see FIG. 7D), and when the input of the driving force is stopped, the drive gear 62 moves to the spaced-apart position (see FIG. 7C). In other words, in a case where it is necessary to rotate the agitator 93 such as during the image formation, the drive gear 62 and the transmission gear 91 can be automatically meshed by inputting the driving force to the drive gear 62. Meanwhile, when it is unnecessary to rotate the agitator 93, the meshing state between the drive gear 62 and the transmission gear 91 can be automatically canceled by stopping the input of the driving force to the drive gear 62. For this reason, it is possible to achieve improvement of convenience. It should be noted that the meshing state refers to a state in which gear teeth of the transmission gear 91 and gear teeth of the drive gear 62 completely mesh with each other, and that the spaced-apart state includes all the states in which they are not in the meshing state.

In addition, the drive gear 62 can move smoothly between the meshing position and the spaced-apart position by virtue of the guide hole 40 provided in the process frame 22.

In addition, the guide hole 40 can be configured simply by a hole or a groove which is provided continuously in such a manner as to span the meshing position and the spaced-apart position and supports the drive gear 62.

In addition, since the supply gear 59 meshing with the drive gear 62 presses the drive gear 62 to the meshing position while inputting the driving force to the drive gear 62, even if a special mechanism is not provided, the drive gear 62 can be moved to the meshing position merely as the supply gear 59 inputs the driving force to the drive gear 62. Consequently, it is possible to achieve a reduction in the number of parts.

In addition, the developer cartridge 31 has a double structure including the outside housing 82 and the inside housing 81 accommodated in the outside housing 82 (see FIG. 8A). Further, since the transmission gear 91 is disposed between the outside housing 82 and the inside housing 81, it is possible to protect the transmission gear 91.

In addition, the transmission gear 91 in the state in which it is meshed with the agitator gear 80 is supported by the link lever 96 movably with respect to the agitator gear 80 (see FIGS. 7A to 7D). For this reason, even when the tooth tips of the transmission gear 91 and the tooth tips of the drive gear 62 collide against each other at the time of installing the developer cartridge 31 to the process frame 22, the transmission gear 91 is not forcibly pressed against the drive gear 62 side. Namely, since the transmission gear 91 can be held on standby in the state in which the tooth tips of the transmission gear 91 and the tooth tips of the drive gear 62 are in slight contact with each other, it is possible to prevent the gear teeth of both the transmission gear 91 and the drive gear 62 from becoming damaged. Further, when the transmission gear 91 and the drive gear 62 are meshed, the driving force inputted to the drive gear 62 can be transmitted to the agitator 93 through the transmission gear 91 and the agitator gear 80.

In addition, the elastic body 41 presses the drive gear 62 to the spaced-apart position, and when the input of the driving force to the drive gear 62 is stopped, the drive gear 62 is moved to the spaced-apart position, as shown in FIG. 7C. As a result, if the input of the driving force to the drive gear 62 is stopped, the drive gear 62 is automatically disposed at the spaced-apart position, so that it is possible to prevent the collision between the teeth tips of the transmission gear 91 and the teeth tips of the drive gear 62 at the time of installing the developer cartridge 31 to the process frame 22. For this reason, the developer cartridge 31 can be smoothly installed to the process frame 22. In addition, if the input of the driving force to the drive gear 62 is stopped at the time of removing the developer cartridge 31 from the process frame 22, the meshing state between the transmission gear 91 and the drive gear 62 can be automatically canceled, making it possible to smoothly remove the developer cartridge 31 from the process frame 22. Thus, it is possible to achieve improvement of convenience by virtue of the elastic body 41 having a simple configuration. It should be noted that, instead of the elastic body 41, the supply gear 59 may press the drive gear 62 downward and move it to the spaced-apart position by reversely rotating the drive gear 62 (rotating in an opposite direction to that of arrow C in FIG. 7D). Of course, if the input of the driving force to the drive gear 62 is stopped, the drive gear 62 may move to the spaced-apart position by its own weight.

MODIFIED EXAMPLES

(1) First Modification

In the above-described embodiment, as shown in FIG. 1, the process cartridge 17 integrally has the photoconductive drum 25 and the development roller 37, and the process cartridge 17 is detachably mounted in the body casing 2. In addition, the process cartridge 17 may be configured such that the development cartridge is not provided with the photoconductive drum 25, while another unit (drum cartridge) having the photoconductive drum 25 is provided, to detachably mount the development cartridge with respect to this drum cartridge. Additionally, in a state in which the process cartridge 17 is kept mounted in the body casing 2, only the developer cartridge 31 may be configured to be detachable.

Furthermore, the body casing 2 may be provided with the photoconductive drum 25, the scorotron-type charger 26, and the transfer roller 28, and the development cartridge may be detachably mounted in that body casing 2.

(2) Second Modification

Although exemplary embodiments of the present inventive concept have been described in relation to a laser printer, the present inventive concept is not limited to a monochrome laser printer. Rather, the present inventive concept can also be applied to a color laser printer, including a tandem type and an intermediate transfer type printer.

(3) Third Modification

As described above, the transmission gear 91 and the agitator gear 80 are disposed between the inside housing 81 and the outside housing 82 (see FIG. 8A), but the transmission gear 91 and the agitator gear 80 may be disposed on the outer side of the outside housing 82 in an exposed manner. In that case, maintenance can be easily provided for the transmission gear 91 and the agitator gear 80.

In addition, the developer cartridge 31 may have a structure having only the inside housing 81 (not a double structure).

According to another aspect of the invention, in the developing device, the moving gear moves to the meshing position when the driving force is transmitted thereto, and the moving gear moves to the spaced-apart position when the transmission of the driving force is stopped.

According thereto, when the driving force is inputted, the moving gear moves to the meshing position, and when the input of the driving force is stopped, the moving gear moves to the spaced-apart position. In other words, in a case where it is necessary to rotate the agitator, the moving gear and the transmission gear can be automatically meshed by inputting the driving force to the moving gear. Meanwhile, when it is unnecessary to rotate the agitator, the meshing state between the moving gear and the transmission gear can be automatically canceled by stopping the input of the driving force to the moving gear. For this reason, it is possible to achieve improvement of convenience.

According to still another aspect of the invention, the developing housing further comprises a guide portion for guiding the moving gear between the meshing position and the spaced-apart position.

According thereto, the moving gear can move smoothly between the meshing position and the spaced-apart position by virtue of the guide portion provided in the developing housing.

According to still another aspect of the invention, the guide portion comprises a hole or a groove for supporting the moving gear, the hole or the groove extending continuously so as to guide the moving gear between the meshing position and the spaced-apart position.

According thereto, the guide portion can be configured simply by a hole or a groove which is provided continuously in such a manner as to span the meshing position and the spaced-apart position and supports the moving gear.

According to still another aspect of the invention, the developing device further comprises a pressing gear that is configured to mesh with the moving gear to transmit the driving force to the moving gear and is configured to press the moving gear to the meshing position when transmitting the driving force to the moving gear.

According thereto, since the pressing gear meshing with the moving gear presses the moving gear to the meshing position while inputting the driving force to the moving gear, even if a special mechanism is not provided, the moving gear can be moved to the meshing position merely as the pressing gear inputs the driving force to the moving gear. Consequently, it is possible to achieve a reduction in the number of parts.

According to still another aspect of the invention, the transmission gear is provided outside of the cartridge housing.

According thereto, since the transmission gear is disposed on the outer side of the cartridge housing, it is possible to easily provide maintenance for the transmission gear.

According to still another aspect of the invention, the cartridge housing further comprises: a first housing; and a second housing accommodated in the first housing, wherein the transmission gear is provided between the first housing and the second housing.

According thereto, the cartridge housing has a double structure including the first housing and the second housing accommodated in the first housing. Further, since the transmission gear is disposed between the first housing and the second housing, it is possible to protect the transmission gear.

According to still another aspect of the invention, the developer cartridge further comprises: an agitation gear that is provided on a rotating shaft of the agitator and is configured to mesh with the transmission gear; and a supporting member for supporting the transmission gear movably with respect to the agitation gear in a meshing state between the transmission gear and the agitation gear.

According thereto, the transmission gear in the state in which it is meshed with the agitation gear is supported by the supporting member movably with respect to the agitation gear. For this reason, even when the tooth tips of the transmission gear and the tooth tips of the moving gear collide against each other at the time of installing the developer cartridge to the developing housing, the transmission gear is not forcibly pressed against the moving gear side. Namely, since the transmission gear can be held on standby in the state in which the tooth tips of the transmission gear and the tooth tips of the moving gear are in slight contact with each other, it is possible to prevent the gear teeth of both the transmission gear and the moving gear from becoming damaged. Further, when the transmission gear and the moving gear are meshed, the driving force inputted to the moving gear can be transmitted to the agitator through the transmission gear and the agitation gear.

According to still another aspect of the invention, the developing device further comprises an actuating member that is configured to move the moving gear to the spaced-apart position when the transmission of the driving force is stopped.

According thereto, when the input of the driving force to the moving gear is stopped, the actuating member moves the moving gear to the spaced-apart position. As a result, if the input of the driving force to the moving gear is stopped, the moving gear is automatically disposed at the spaced-apart position, so that it is possible to prevent the collision between the teeth tips of the transmission gear and the teeth tips of the moving gear at the time of installing the developer cartridge to the developing housing. Hence, the developer cartridge can be smoothly installed to the developing housing. In addition, if the input of the driving force to the moving gear is stopped at the time of removing the developer cartridge from the developing housing, the meshing state between the transmission gear and the moving gear can be automatically canceled, making it possible to smoothly remove the developer cartridge from the developing housing. For this reason, it is possible to achieve improvement of convenience.

According to still another aspect of the invention, the actuating member comprises an elastic body for pressing the moving gear to the spaced-apart position.

According thereto, the actuating member can be configured simply by an elastic body for pressing the moving gear to the spaced-apart position.

While the present invention has been shown and described with reference to certain exemplary embodiments thereof, it will be understood by those skilled in the art that various changes in form and details may be made therein without departing from the spirit and scope of the invention as defined by the appended claims.

What is claimed is:

1. A developing device comprising:

a developing housing that supports a developer carrier; and a developer cartridge comprising:

a cartridge housing that is configured to accommodate developer;

an agitator that is provided in the cartridge housing and is configured to agitate the developer by a driving force;

a transmission gear that is configured to transmit the driving force to the agitator and the transmission gear is configured to rotate about a rotation axis of the transmission gear; and an agitator gear that is provided on a rotating shaft of the agitator and meshes with the transmission gear, wherein the developing housing comprises a moving gear that is movable between a meshing position in which the moving gear meshes with the transmission gear and a spaced-apart position in which the moving gear is spaced apart from the meshing position, wherein the moving gear is configured to transmit the driving force from the transmission gear to the agitator, and wherein the rotation axis of the transmission gear is pivotable about the rotating shaft of the agitator.

2. The developing device according to claim 1, wherein:

the transmission gear comprises gear teeth on an end face thereof in a perpendicular direction to a longitudinal direction of the developer carrier;

the developer cartridge is attachable to and detachable from the developing housing along the perpendicular direction; and the moving gear comprises gear teeth formed on an end face thereof in the perpendicular direction.

3. The developing device according to claim 1, wherein the moving gear moves to the meshing position when the driving force is transmitted thereto, and wherein the moving gear moves to the spaced-apart position when the transmission of the driving force is stopped.

4. The developing device according to claim 1, wherein the developing housing further comprises a guide portion for guiding the moving gear between the meshing position and the spaced-apart position.

5. The developing device according to claim 4, wherein the guide portion comprises a hole for supporting the moving gear, the hole extending continuously so as to guide the moving gear between the meshing position and the spaced-apart position.

6. The developing device according to claim 4, wherein the guide portion comprises a groove for supporting the moving gear, the groove extending continuously so as to guide the moving gear between the meshing position and the spaced-apart position.

7. The developing device according to claim 1, further comprising:

a pressing gear that is configured to mesh with the moving gear to transmit the driving force to the moving gear and is configured to press the moving gear to the meshing position when transmitting the driving force to the moving gear.

8. The developing device according to claim 1, wherein the transmission gear is provided outside of the cartridge housing.

9. The developing device according to claim 1, wherein the cartridge housing further comprises:

a first housing; and a second housing rotatably accommodated in the first housing, wherein the transmission gear is provided between the first housing and the second housing.

10. The developing device according to claim 1, wherein the developer cartridge further comprises:

a supporting member for supporting the transmission gear movably with respect to the agitation gear in a meshing state between the transmission gear and the agitation gear.

11. The developing device according to claim 1, further comprising:

an actuating member that is configured to move the moving gear to the spaced-apart position when the transmission of the driving force is stopped.

12. The developing device according to claim 11, wherein the actuating member comprises an elastic body for pressing the moving gear to the spaced-apart position.

* * * * *